US009266028B2

(12) United States Patent
Alfieri et al.

(10) Patent No.: US 9,266,028 B2
(45) Date of Patent: Feb. 23, 2016

(54) TOWER RIDE

(71) Applicant: Raven Sun Creative, Inc., Middle Grove, NY (US)

(72) Inventors: Louis F. Alfieri, Middle Grove, NY (US); Patrick Spieldiener, Schaan (LI)

(73) Assignee: Raven Sun Creative, Inc., Middle Grove, NY (US)

( * ) Notice: Subject to any disclaimer, the term of this patent is extended or adjusted under 35 U.S.C. 154(b) by 0 days.

(21) Appl. No.: 14/547,106

(22) Filed: Nov. 18, 2014

(65) Prior Publication Data

US 2015/0141161 A1 May 21, 2015

Related U.S. Application Data

(60) Provisional application No. 61/905,383, filed on Nov. 18, 2013.

(51) Int. Cl.
*A63G 31/00* (2006.01)
*A63G 31/16* (2006.01)

(52) U.S. Cl.
CPC ..... *A63G 31/00* (2013.01); *A63G 31/16* (2013.01); *A63G 2031/002* (2013.01)

(58) Field of Classification Search
CPC ..... A63G 31/00
See application file for complete search history.

(56) References Cited

U.S. PATENT DOCUMENTS 3,933,326 A 1/1976 Schauffler
5,192,247 A 3/1993 Barr et al.
5,453,011 A 9/1995 Feuer et al.
5,527,221 A 6/1996 Brown et al.
5,791,903 A 8/1998 Feuer et al.
5,857,917 A 1/1999 Francis et al.
5,964,666 A * 10/1999 Uemura ..... A63G 31/00 472/2
6,076,638 A * 6/2000 Gertz ..... B66B 3/008 187/414
6,629,895 B2 * 10/2003 Uemura ..... A63G 31/16 472/131
7,766,754 B2 8/2010 Davison, Jr. et al.
8,641,540 B2 2/2014 Feuer et al.
2002/0068641 A1 6/2002 Dicicco
2005/0014567 A1 1/2005 Li et al.
2011/0136581 A1 6/2011 Cortelyou et al.

OTHER PUBLICATIONS

International Search Report, Written Opinion of the International Searching Authority, and Search History for International Appl. No. PCT/US2014/066243, Feb. 13, 2015.

* cited by examiner

*Primary Examiner* — Michael Dennis
(74) *Attorney, Agent, or Firm* — Christopher J. Kulish

(57) ABSTRACT

An amusement ride is provided that moves a rider in a manner that is synchronized with a video image being displayed on a screen visible to the rider. In one embodiment, the ride is comprised of a rider station for supporting a rider, a trolley that supports the station, a tower that vertically guides the trolley, a motor system for vertically moving the trolley along the tower, an actuator system for moving the station relative to the trolley, a projector system, a screen, and a controller for synchronizing the movement of the station and any rider disposed in the station with imagery projected onto the screen. The controller is adapted to position the station using the motor and/or actuator system in a manner that is synchronized with the imagery being displayed on the screen.

27 Claims, 17 Drawing Sheets

TOWER RIDE

FIELD OF THE INVENTION

The invention relates to an amusement park ride and, more specifically, to an amusement park ride that moves a rider in a manner that is synchronized with a video presentation that is being displayed on a screen which is visible to the rider.

BACKGROUND OF THE INVENTION

Presently, there are amusement park rides that vertically move a rider and have some kind of imagery that the rider is capable of viewing while on the ride. An example of such a ride is the "Tower of Terror" ride at various Disney amusement parks. In this ride, a rider is disposed on an elevator that moves between the floors of a haunted hotel. When the elevator stops at a particular floor, the rider is exposed to the "haunted" imagery associated with that floor. For example, the rider may be exposed to ghosts of prior denizens of the hotel where the images of the ghosts are generated using the "Pepper's Ghost" effect. Another type of amusement park ride endeavors to make the rider feel as if the rider is participating in the imagery that is being displayed on a screen by employing actuators to move the rider's chair and the rider relative to a platform in a manner that is synchronized with the imagery being displayed on a screen visible to the rider. By moving the rider in this manner, the rider believes that they are experiencing the forces that the rider would experience if actually participating in the scene being displayed. The actuators used to move the rider's chair are limited to a relatively small range of motion, typically, no more than about 24 inches. As such, many of these rides employ movement techniques that "trick" the rider's mind into believing that they are experiencing movements and forces commensurate with the image being viewed on the screen that are significantly greater than the movements and forces that the actuators are actually capable of generating. For instance, if the image being displayed on the screen is of the cockpit of a fighter jet that is banking into a turn, the chair actuators can be used to tilt the chair and thereby cause the rider to believe that they are in the cockpit of the jet and making the turn. However, if the actuator cannot tilt the chair far enough to reasonably reflect the degree to which the jet fighter is banking, the ride may tilt the image of the banking jet being displayed on the screen in the opposite direction from which the chair is being tilted. This typically "tricks" the rider's mind into believing that they are in the jet fighter and making the steep banking turn being displayed on the screen.

SUMMARY OF THE INVENTION

The invention is directed to an amusement park ride that moves a rider in a manner that is synchronized with a video image being displayed on a screen that is visible to the rider such that the rider can have a simulated experience of environments that known rides cannot simulate or cannot convincingly simulate for the typical rider.

In one embodiment, an amusement park ride is provided that includes a rider station for supporting a rider in a predetermined position, a rider station trolley for supporting the rider station, a tower operatively engaged to the rider station trolley such that the tower constrains the trolley to being moved vertically up and down the tower, a screen, and a projector system for projecting imagery onto the screen. The ride further includes two systems for imparting motion to the rider station. The first system is a motor system that is operatively engaged to the trolley and operates to vertically move the trolley along the tower. The second system is an actuator system that operates to move the rider station relative to the rider station trolley. A controller is provided that engages the projector, motor system, and actuator system and operates so as to synchronizes the position of the rider station and any rider disposed in the rider station with the imagery being produced on the screen by appropriate use of the motor system and actuator system. To elaborate, the control system is adapted to cause the motor system to vertically position the rider station along the tower so as to coordinate the vertical position of the rider station with the imagery being projected on the screen. Such positioning may involve imparting a high G ascent, a negative G descent, and/or a substantially constant rate of ascent or descent. The control system is also adapted to cause the actuator system to position the rider station relative to the rider station trolley so as to coordinate the position of the rider station relative to the trolley with imagery being projected onto the screen. In a particular embodiment, the actuator system provides the ability to roll, pitch, and yaw the rider station (i.e., impart rotational movement to the rider station about x, y, and z axes). In another embodiment, the actuator system provides the addition ability to surge, heave, and sway (i.e., provide translation movement along x, y, and z axes). The ability to move the rider station with two different motion imparting systems facilitates the simulation of a large range of motions for a rider disposed in the rider station. For example, if an object in video imagery being displayed on the screen and whose motion is to be simulated for a rider located in the rider station is experiencing a rapid ascent with a low amplitude but relatively high frequency vibration (e.g., the launching of a rocket), the controller can employ: (a) the motor system to impart the high G effect of the lift off to the rider station by causing the rider station to accelerate up the tower and (b) the actuator system to impart the low amplitude but relatively high frequency vibration by rapidly rolling, pitching, and/or yawing the rider station back and forth over relatively short rotational extents. In a particular embodiment, the controller is capable of causing the actuator system to position the rider station relative to the rider station trolley over substantially the entire vertical extent that the controller is capable of causing the motor system to position the rider station along the tower.

Another embodiment of an amusement park ride includes a rider station for supporting a rider in a predetermined position, a rider station trolley for supporting the rider station, a rider station tower operatively engaged to the rider station trolley such that the tower constrains the trolley to being moved vertically up and down the tower, a motor system for vertically moving the rider station and rider station trolley along the tower, a screen that is stationary relative to the rider station trolley, and a projector for projecting imagery onto the screen. The ride further includes a projector mount that supports the projector and is adapted to move substantially synchronously with the rider station trolley. A controller that is operatively engaged with the projector and motor system is adapted to cause the motor system to vertically position the rider station along the tower so as to coordinate the vertical position of the rider station with imagery produced by the projector and displayed on the screen. In several embodiments, the substantially synchronous movement of the projector mount and projector relative to the rider station trolley result in the position of the projector mount and projector relative to the rider station trolley remaining substantially constant. In a particular embodiment, the ride includes a projector trolley that is engaged to the projector mount and a projector tower that engages the projector trolley. The projector tower is separate from the rider station tower to dampen vibrations produced by the motion of the rider trolley that might adversely affect the imagery being produced by the projector and projected onto the screen. In one embodiment, a cable that extends between the projector trolley and a counterweight (which is also part of the motor system) facilitates the synchronized movement of the projector trolley and the rider station trolley. If this connection imparts undesirable vibrations produced by the motor system to the project, a cable that employs a damper adapted to reduce the vibrations imparted to the projector is employed.

Yet another embodiment of an amusement park ride includes a rider station for supporting a rider in a predetermined position, a rider station trolley for supporting the rider station, a rider station tower operatively engaged to the rider station trolley such that the tower constrains the trolley to being moved vertically up and down the tower, and a motor system for vertically moving the rider station and rider station trolley along the tower. Additionally, the ride includes a projector, a projector trolley for supporting the projector, and a projector tower that engages the projector trolley and constrains the projector trolley to being vertically moved up and down the projector tower. A screen is provided for receiving imagery produced by the projector. A controller that is operatively engaged with the projector and motor system is adapted to cause the motor system to vertically position the rider station along the tower so as to coordinate the vertical position of the rider station with imagery produced by the projector and displayed on the screen. In a particular embodiment, several of the elements of the ride have a footprint that facilitates the efficient use of space to support the ride while also facilitating the desired immersive experience for the rider. In this regard, the rider station and rider station trolley have a first footprint, the rider station tower has a second footprint, and the project tower has a third footprint that is located between the first and second footprints.

One embodiment of the invention includes a rider station, a rider trolley that supports the rider station, a tower that engages the rider trolley in a manner that vertically guides the rider trolley, a motor system for vertically moving the rider trolley up and down the tower, a projector for producing video imagery, and a screen for receiving the video imagery produced by the projector and situated for viewing by a rider located at the rider station. The tower and the motor system are capable of moving the rider station and trolley relative to the tower such that a rider experiences a high G ascent, a negative G descent, and variable speeds of ascent and descent that are synchronized with the imagery being displayed on the screen. This allows a significantly broader range of environments in which high G, high negative G, and variable speeds or ascent and descent are present to be simulated for the rider. In another embodiment, an actuator system is provided that is operatively connected to the rider station and the trolley. The actuator system, in a particular embodiment, allows the rider station to be moved in six degrees of freedom, namely, three linear degrees of freedom (i.e., linear movement along x, y, z axes) and three rotational degrees of freedom (i.e., rotational movement about the x, y, and z axes, which are also referred to as roll, pitch, and yaw). An actuator system with less than six degrees of freedom can be employed.

In another embodiment of the invention, a projector trolley is provided that supports the projector and engages the tower such that the projector can be vertically moved up and down the tower. In a particular embodiment, the projector trolley and the rider trolley are coupled to one another such that the location of the projector trolley does not change relative to the rider trolley when the trollies are vertically moved up and down the tower. As such, the image projected onto the screen by the projector moves up and down the screen as the projector and rider trollies move up and down the tower. Further, the projector is located such that the image cone of the projector lies outside the location of a typical rider situated at the rider station and any other elements of the ride, thereby producing an image on the screen that does not include the shadow of a typical rider or the shadow of any of the other elements of the ride. The image cone is also located so that the image produced on the screen is within the viewing cone of a typical rider located at the rider station. The viewing cone of the typical rider is the field of view of a rider with normal visual perception when the rider's head is in the normal primary straight head position, i.e., not tilted relative to the torso when the person is sitting or standing normally.

Yet another embodiment of the invention employs a screen that is the concave surface of a cylinder or cylinder section. The lateral extent of the screen is at least coextensive with the lateral extent of the typical rider's vision cone. As such, when an image is projected on the screen that fills the lateral extent of the screen, a rider located at the rider station will feel as if they are surrounded by the environment set forth in the image. In a further embodiment, a stereoscopic projector is employed to project 3D images onto the screen that the rider can view with the use of appropriate glasses, thereby further enhancing the immersive effect of the ride on the rider.

DETAILED DESCRIPTION

Figure 1:
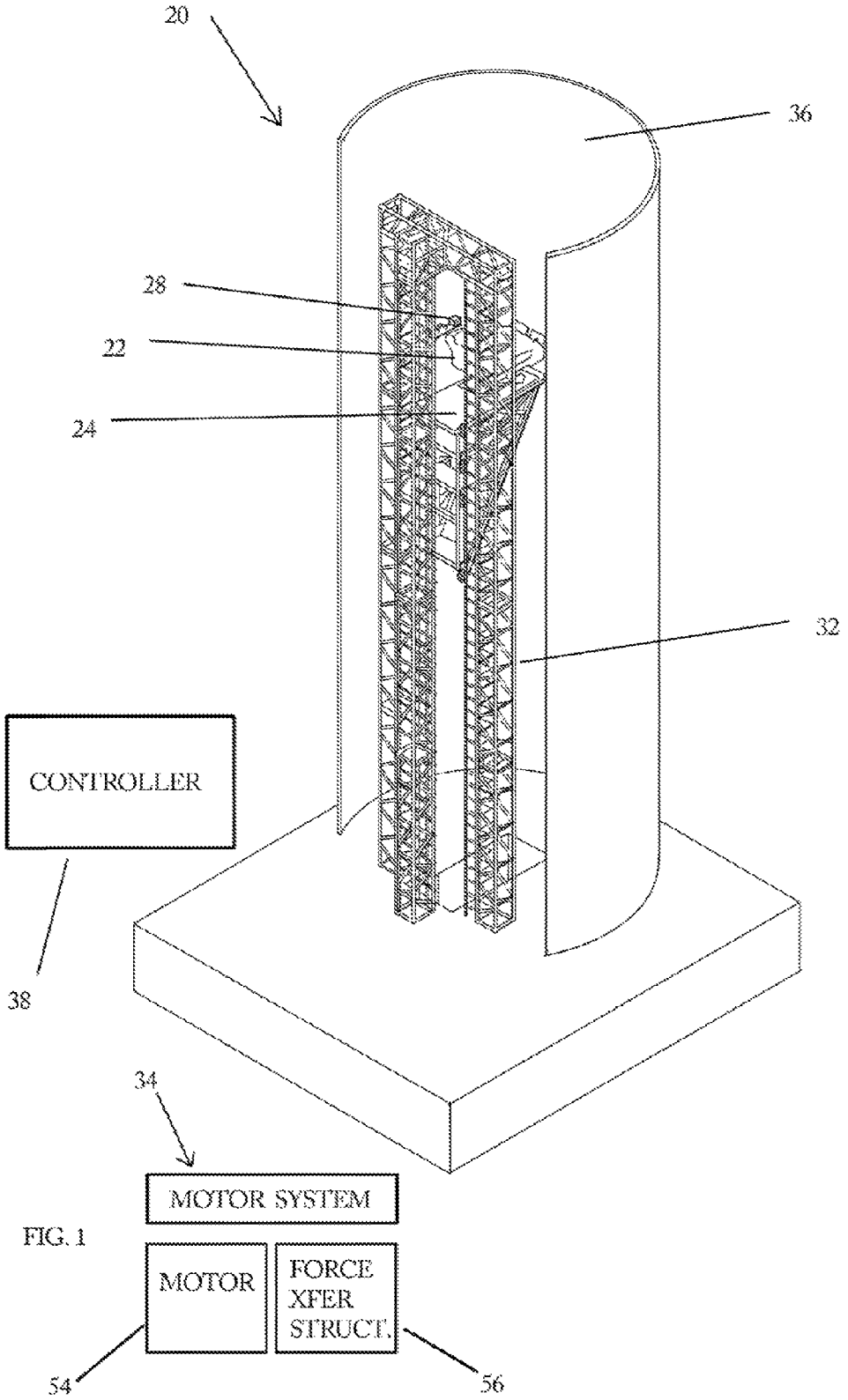
FIG. 1 illustrates an embodiment of a tower ride that operates to synchronize the motion of a rider with a video image being displayed on a screen and visible to the rider.
Figure 2:
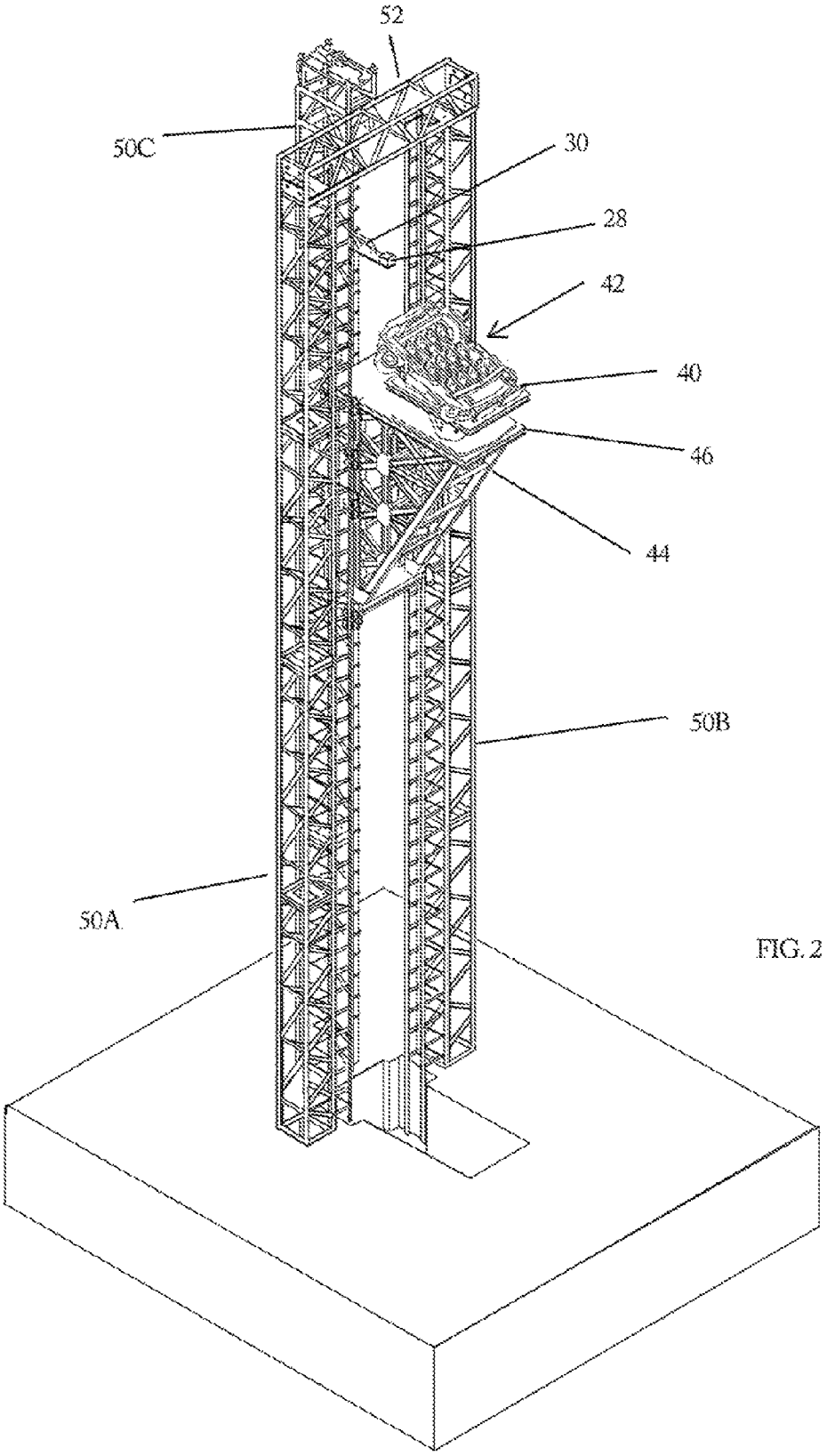
FIG. 2 illustrates portions of the embodiment of the tower ride shown in FIG. 1.
Figure 3:
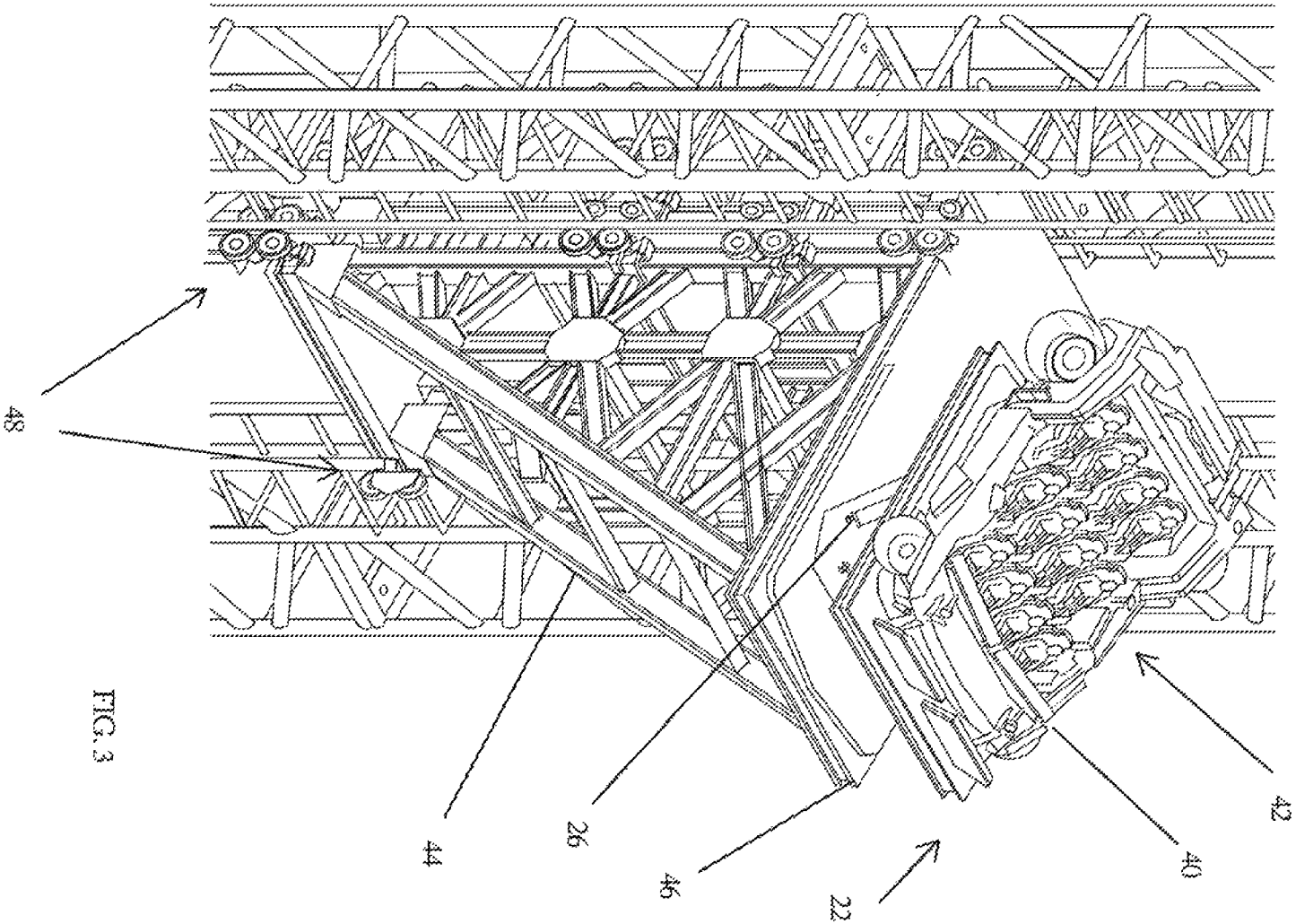
FIG. 3 is a perspective view of the rider station and a portion of the tower of the embodiment of the tower ride shown in FIG. 1.
Figure 4:
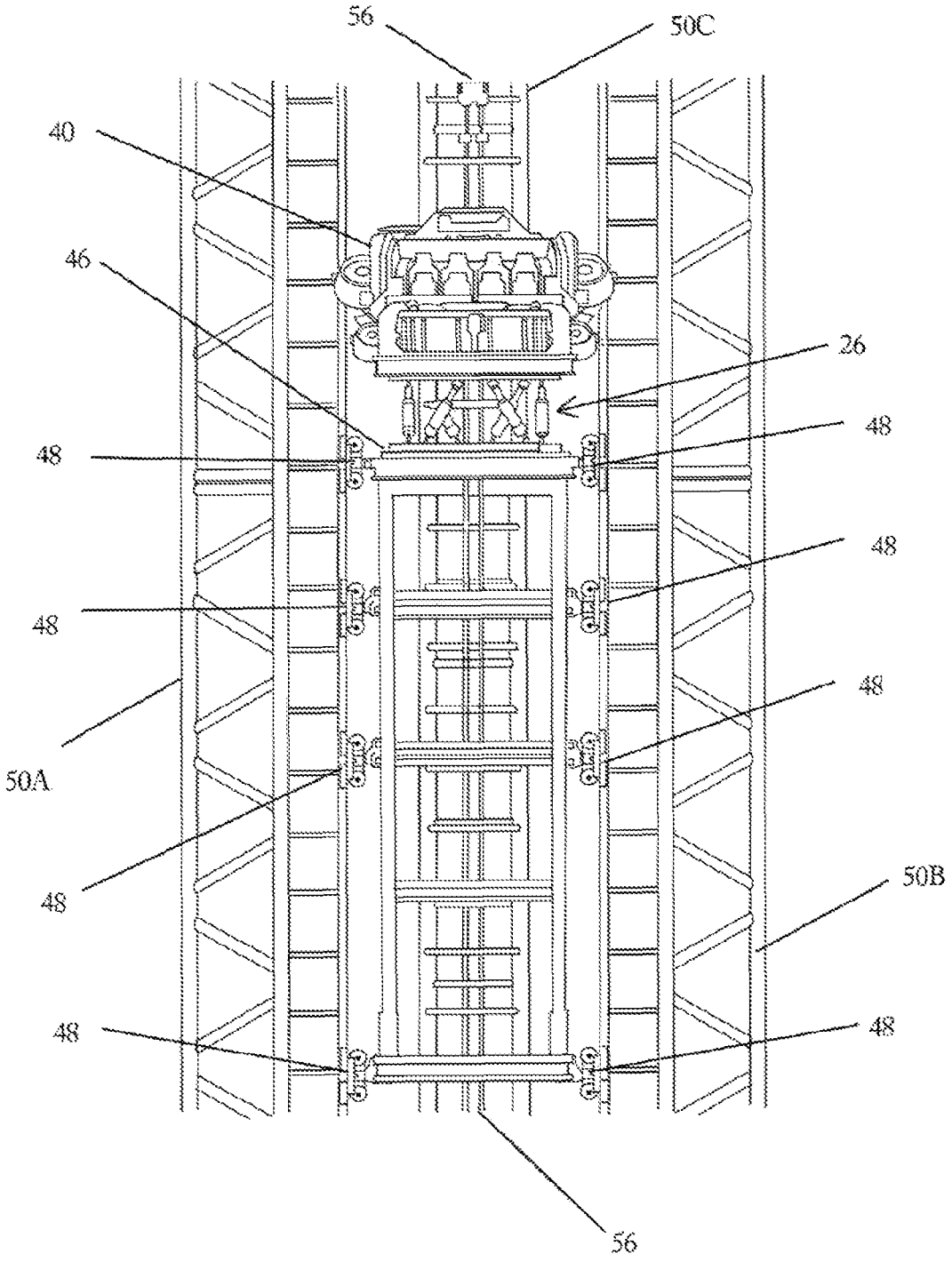
FIG. 4 is an orthogonal view of the rider station and a portion of the tower of the embodiment of the tower ride shown in FIG. 1.

Generally, the invention is directed to an amusement park ride that moves a rider in a manner that is synchronized with a video image being displayed on a screen that is visible to the rider such that the rider can have a simulated experience of moving in the environment being displayed on the screen and, if appropriate for the image being displayed, moved such that the rider experiences a high positive G force, a negative G force, and/or substantial changes in speed. The ride is comprised of a rider station for supporting a rider in a desired position, a rider trolley that supports the rider station, a tower that engages the rider trolley in a manner that vertically guides the rider trolley, a motor system for vertically moving the rider trolley and rider station up and down the tower, a projector for producing video imagery, a screen for receiving the video imagery produced by the projector and situated for viewing by a rider located at the rider station, and a controller that synchronizes the movement of the rider station with the image produced by the projector and displayed on the screen.

With reference to FIGS. 1-4, an embodiment of the amusement park ride 20 is described. The amusement park ride 20 includes: (a) a rider station 22, (b) a rider trolley 24 that supports the rider station 24 (the rider trolley is sometimes referred to as the rider station trolley) , (c) an actuator system 26 for moving the rider station 24 relative to the rider trolley 24, (d) a projector 28, (e) a projector trolley 30 that supports the projector 28, (f) a tower 32 that engages the rider and projection trolleys 24, 30 and constrains the trolleys to vertical movement up and down the tower, (g) a motor system 34 for applying the forces needed to control the vertical movement of the rider station 22, rider trolley 24, projector 28, and projector trolley 30 adjacent to the tower 32, (h) a screen 36 positioned to receive an image produced by the projector and so that the image produced on the screen can be seen a rider located at the rider station 22, and (i) a controller 38 that synchronizes the movement of the rider station 22 with the image being produced on the screen 36.

The rider station 22 includes a car 40 that support a plurality of chairs 42 that support riders such that a rider seated in any one of the chairs will be facing the screen 36. The plurality of chairs 42 are disposed in three tiers in an effort to provide each of the riders with a view of the screen 36 that is substantially unobstructed by the presence of another rider.

The rider trolley 24 is comprised of a truss 44, a platform 46 that supports the car 40, and several pairs of tower engagement wheels 48 with each pair of engagement wheels engaging one of four guide rails associated with the tower 32. The actuator system 26 connects the car 40 to the platform 46 and is adapted to move the car 40 relative to the platform 46 in up to six degrees of freedom. The six degrees of freedom being linear movement along the x, y, z axes (typically referred to as surge, heave, and sway) and rotational movement about the x, y, and z axes (typically referred to as roll, pitch, and yaw). Typically, the actuator system 26 is adapted to move the car 40 in all six degrees of freedom or the three linear degrees of freedom. However, any combination of one or more of the six degrees of freedom can be implemented. The actuator system 26 is comprised of hydraulic or pneumatic actuators. However, the actuator system 26 can be implemented with other types of actuators and combinations of different types of actuators.

The projector 28 is a stereoscopic projector for projecting video images on the screen 36 that appear as three-dimensional (3D) images to a rider wearing appropriate eyewear for viewing such images. A conventional or standard two-dimensional (2D) projector can also be utilized. The projector trolley 30 supports the projector 28 such that the image cone produced by the projector does not intersect any of the other elements of the ride or even an exceedingly tall rider seated in any one of the plurality of chairs 42 when the chair is moved through the entire range of motion provided by the actuator system 26. An exceedingly tall rider being an individual whose height, including hair and/or hat as worn by the individual when on the ride, is greater than about 2.4 meters (8 feet). Further, the positions of the projector 28 and projector trolley 30 are fixed relative to the rider trolley 24. Consequently, the image produced by the projector 28 and projected onto the screen 36 moves up and down the screen as the rider station 22 moves up and down the tower 32. The projector 28 is vibrationally isolated from the remainder of the ride 20 to prevent vibrations caused by the movement of the rider station 22 up and down the tower 32 and other elements of the ride 20 from adversely affecting the image produced on the screen 36 by the projector 23. Vibrational isolation can be accomplished in a number of ways. For instance, the projector 28 can incorporate or be equipped with an image stabilization mechanism. Alternatively, the projector 28 can be located on a separate tower that is vibrationally isolated from whatever tower structure is used to support and vertically guide a rider station and whatever other elements of the ride might cause the projector 28 to vibrate in an undesirable manner.

The tower 32 is comprised of three sub-towers 50A-50C, each having one end embedded in the ground and an opposite end connected to each of the other three sub-towers 50A-50C by a transverse truss 52. The sub-towers 50A, 50B each include a pair of vertically extending, parallel guide rails that each engage multiple pairs of the tower engagement wheels 48 of the rider trolley 24 and constrain the rider trolley 24 to move vertically along the rails. The sub-tower 50C and transverse truss 52 supports portions of the motor system 34 that engage the rider and projector trolleys 24, 30 and are used to apply the forces necessary to vertically move the trolleys 24, 30 up and down the tower 32. While the tower 32 is comprised of the three sub-towers 50A-50C and the transverse truss 52, other tower structures capable of vertically guiding a rider station and accommodating the physical requirements associated with the vertical movement of the rider station are feasible. For example, towers with less than three sub-towers, towers with more than three sub-towers, and other types of tower structures known to those skilled in the art are feasible.

The motor system 34 is comprised of a motor 54 for producing the necessary forces to move the rider and projector trolleys 24, 30 up and down along the tower 32 as desired and a force transfer structure 56 for applying the forces produced by the motor to the rider and projector trolleys 24, 30. In the illustrated embodiment, the force transfer structure 56 includes a cable and pulley system with fittings that connect the cable to the rider and projector trolleys 24, 30. In one embodiment, the motor 54 is a hydraulic motor and the force transfer structure 56 includes a cable and wench structure that is capable of applying the forces to the rider trolley 24 so that a rider in the car 40 can experience a high G ascent and a negative G descent. Further, the hydraulic motor and wench are capable of varying the speeds of ascent and descent over a substantial range and with desired profiles. It should be appreciated that a number of other different types of motors and different types of force transfer structures that are capable of imparting the desired movement to the rider station 22 (e.g., high G upward movement, negative G downward movement, and variable speed upward and downward movements) and known to those skilled in the art are feasible. For instance, the motor can be an electric motor and the force transfer structure can be a cable-wench structure.

The screen 36 is the concave surface of a cylinder section and extends to a height that is approximately equal to the height of the tower 32. The concave surface has a lateral extent that at least covers the lateral extent of a typical rider's field of view when located in any one of the plurality of chairs 40 and the rider's head is in the normal primary straight head position, i.e., not tilted relative to the torso. It is believed that, by employing a curved screen and projecting images onto the screen that extend across the portion of the screen that is within the lateral extent of the typical rider's field of view, the rider feels as if they are surrounded by the environment that is being projected onto the screen. This effect is believed to be further enhanced by the projection of 3D images onto the screen 36.

The controller 38 operates to control the operation of each of the actuator system 26, the projector 28, and the motor system 34 so as to synchronize the movements experienced by a rider that is properly situated in one of the plurality of chairs 42 in the car 40 with the imagery that the projector 28 is projecting onto the screen 36. In this regard, the controller 38 controls the motor system 34 so that the rider station 24 is vertically moved or, if not being vertically moved, positioned at a vertical location that is synchronized with the image being shown on the screen 36. In this regard, the controller 38 is capable of applying control signals to the motor system 34 to cause the rider station 24 to move vertically upward such that the rider experiences a positive G force, move vertically downward such that the rider experiences a negative G force or weightlessness, move vertically upward with a desired velocity profile, move vertically downward with a desired velocity profile, and stop at a particular vertical location. The controller 38 is also capable of controlling the actuator system 26 so as to cause the rider station 24 to be moved in one to six degrees of freedom, depending on the configuration of the actuator system 26. In the case of an actuator system 26 that is capable of moving the rider station 24 in six degrees of freedom, the controller 38 is capable of issuing signals to the actuator system that cause the rider station 24 to move linearly along x, y, and z axes and to rotate about x, y, and z axes to a limited extent. The controller 38 also has an operator interface that allows an operator to initiate and terminate the operation of the ride 20.

The controller 28 is also capable of being used to select the video images that are displayed on the screen 36 by the projector 28 from a catalog of videos. For example, if only one video is to be played over the duration of a ride on the ride 20, the controller can be used to select a video from the catalog according to a predefined sequence or randomly selected from the catalog, thereby causing the video that is played during the ride to at least occasionally change. Further, if several videos from the catalog are to be played over the duration of a single ride on the ride 20, the controller 28 is capable of causing the projector 28 to display the videos in a predefined sequence or in a random sequence.

The ride 20 can also include a number of other special effect devices that may be appropriate for use with the particular imagery being displayed on the screen 36. For instance, the ride 20 can incorporate audio speakers, water spritzers, ticklers, odor generators, wind generators, rumblers, lighting effects, fog generators, a heat generators to name a few. Typically, special effects devices like audio speakers, water spritzers, ticklers, odor generators and wind generators are associated with each chair of the ride 20 or in close proximity to two or more chairs of the ride 20. While several of these effects are typically associated with each chair on in close proximity to a number of chairs, many of the noted effects can be located elsewhere on the ride 20. For example, fog generators may be located at fixed locations near the base of the tower 32 and lighting effects can be situated at fixed locations throughout the structure of the ride 20. If the ride 20 includes any such special effect devices, the controller 38 is capable of controlling each of these effects so that, if needed, the sensory effect produced by the device is synchronized with the video image being displayed on the screen 36.

Figure 5:
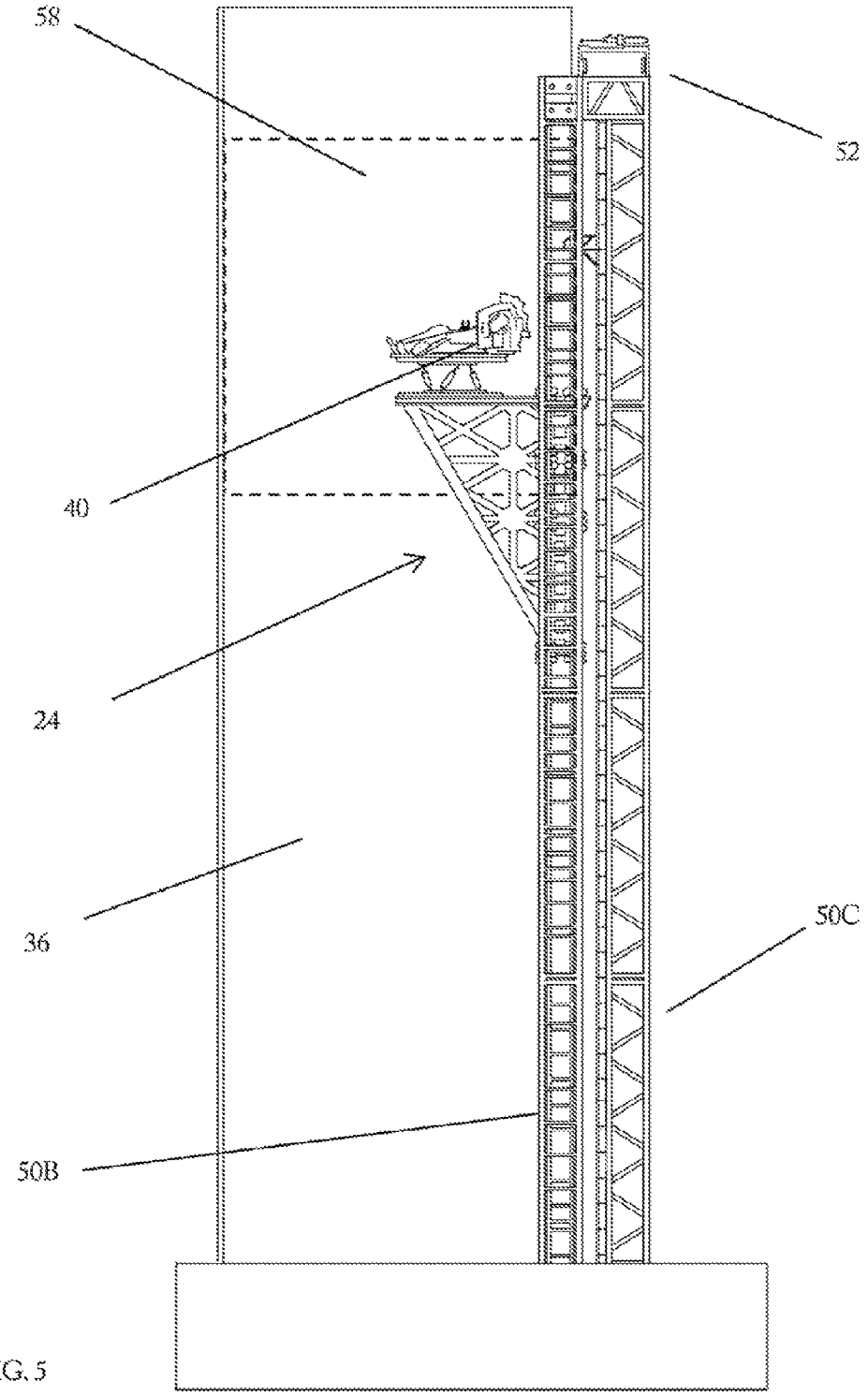
FIG. 5 is view of the rider station, tower, and a portion of the screen with an image being projected on the screen and viewable by a rider associated with the rider station.
Figure 6:
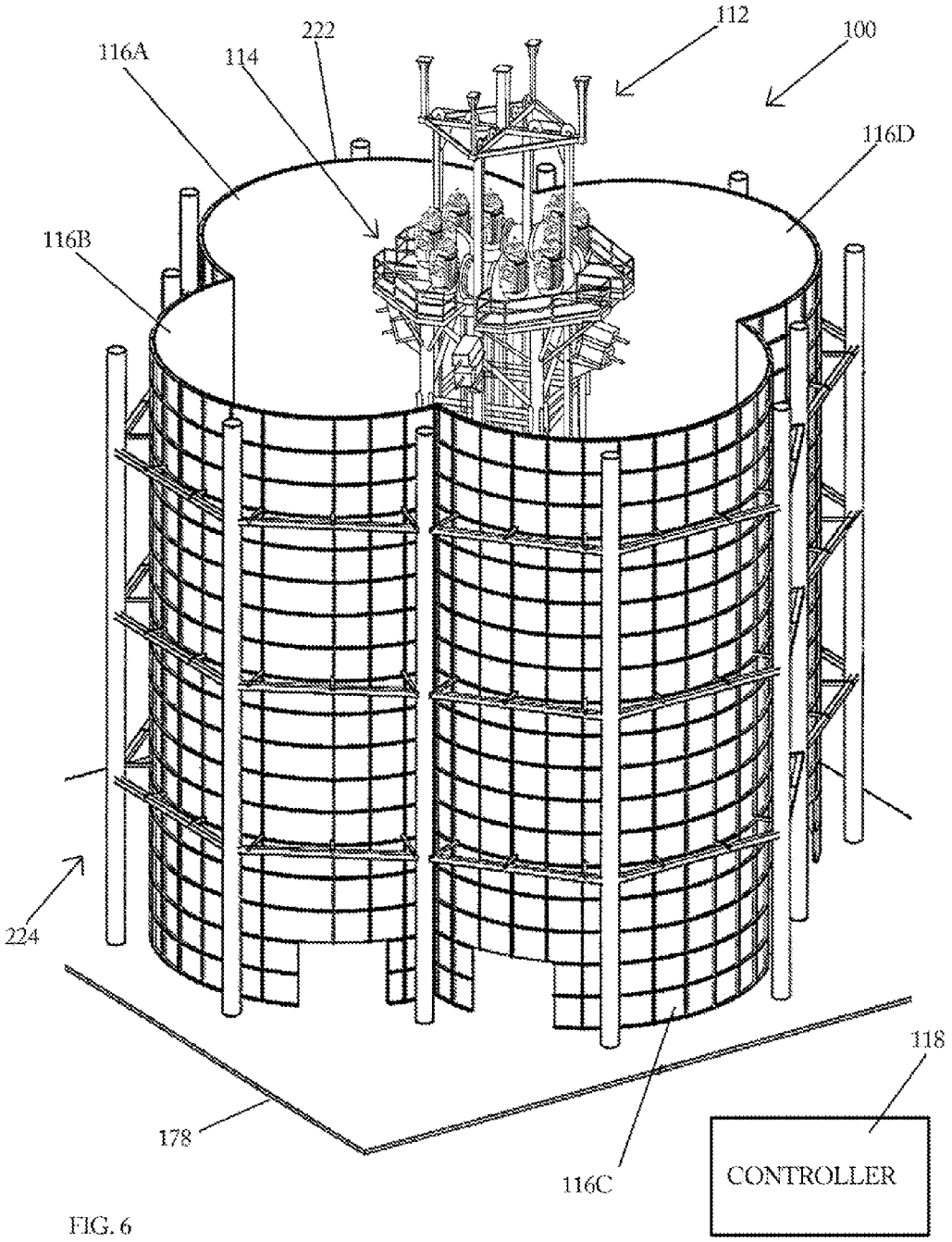
FIG. 6 is a perspective view of a second embodiment of a tower ride that is adapted for synchronizing the motion that a rider experiences with a video image being displayed on a screen that is visible to the rider.

FIG. 5 illustrates the ride 20 in use. More specifically, the motor system 34 has been used to position the rider station 22 at a vertically elevated position on the tower 32. The projector 28 is projecting an image 58 on the screen 36 (only half of the screen 36 being illustrated). The image 58 extends on the screen to a vertical extent above and below the car 40 in which riders are seated that encompasses the vertical extent of the field of view of the typical rider. Similarly, the image 58 has a horizontal or lateral extent that goes well behind the car 40 and, as such, encompasses the lateral extent of the field of view of the typical rider situated in one of the chairs in the car 40. Further, the controller 38 is issuing the appropriate control signals to: (a) the motor system 34 to move the rider station 22 up and down the tower 32, (b) the actuator system 26 to move the plurality of chairs 42 in the car 40, and (c) any other special effects device in synchronization with the image 58 being displayed on the screen 36.

With reference to FIGS. 6-16, a second embodiment of an amusement park ride 100 (hereinafter commonly referred to as "tower ride 100") is described. Generally, the tower ride 100 is comprised of: (a) four rider stations 102A-102D, (b) a rider trolley 104 (or rider station trolley 104) that supports the rider stations 102A-102D, (c) four actuator systems 106A-106D, each associated with one of the four rider stations 102A-102D and used to move the rider station relative to the rider trolley 104, (d) four projector systems 108A-108D, each associated with one of the four rider stations 102A-102D and used to projector an image on a screen visible to a rider situated in the rider station, (e) four projector trolleys 110A-110D, each supporting one of the projector systems 108A-108D, (f) a tower structure 112 that engages the rider trolley 104 and the projection trolleys 110A-110D and constrains the trolleys to vertical movement up and down the tower structure; (g) a motor system 114 that produces and applies the energy necessary to vertically move the rider trolley 104 (together with the associated rider stations 102A-102D, actuator systems 106A-106D, and any riders) and the projector trolleys 110A-110D (together with the projector systems 108A-108D) adjacent to the tower structure 112; (h) screens 116A-116D, each associated with one of the four rider station 102A-102D, and (i) a controller 118 that synchronizes the movement of the rider stations 102A-102D with an image being projected onto the screens 116A-116D.

The rider stations 102A-102D are substantially identical to one another. Consequently, rider station 102A is described with the understanding that the description of rider station 102A is applicable to each of rider stations 102B-102D. The rider station 102A includes a car 122 (sometimes referred to as "gondola 122") and a plurality of seats 124. Each of the plurality of seats 124 supports a rider such that, when the rider is in a normal seated position with their head in the normal primary straight head position, the rider's field of vision includes the relevant one of the screens 116A-116D associated with the rider station. The rider station 102A can also include a number of other special effect devices that may be appropriate for use with the particular imagery being displayed on the screen 116A. For instance, the rider station 102A can incorporate audio speakers, water spritzers, ticklers, odor generators, wind generators, rumblers, lighting effects, fog generators, a heat generators to name a few. Typically, such special effects are associated with each seat or in close proximity to two or more seats. If the rider station 102A includes any such special effect devices, the controller 108 is capable of controlling each of these effects so that, if needed, the sensory effect produced by the device is synchronized with the video image being displayed on the screen 116A.

Figure 7:
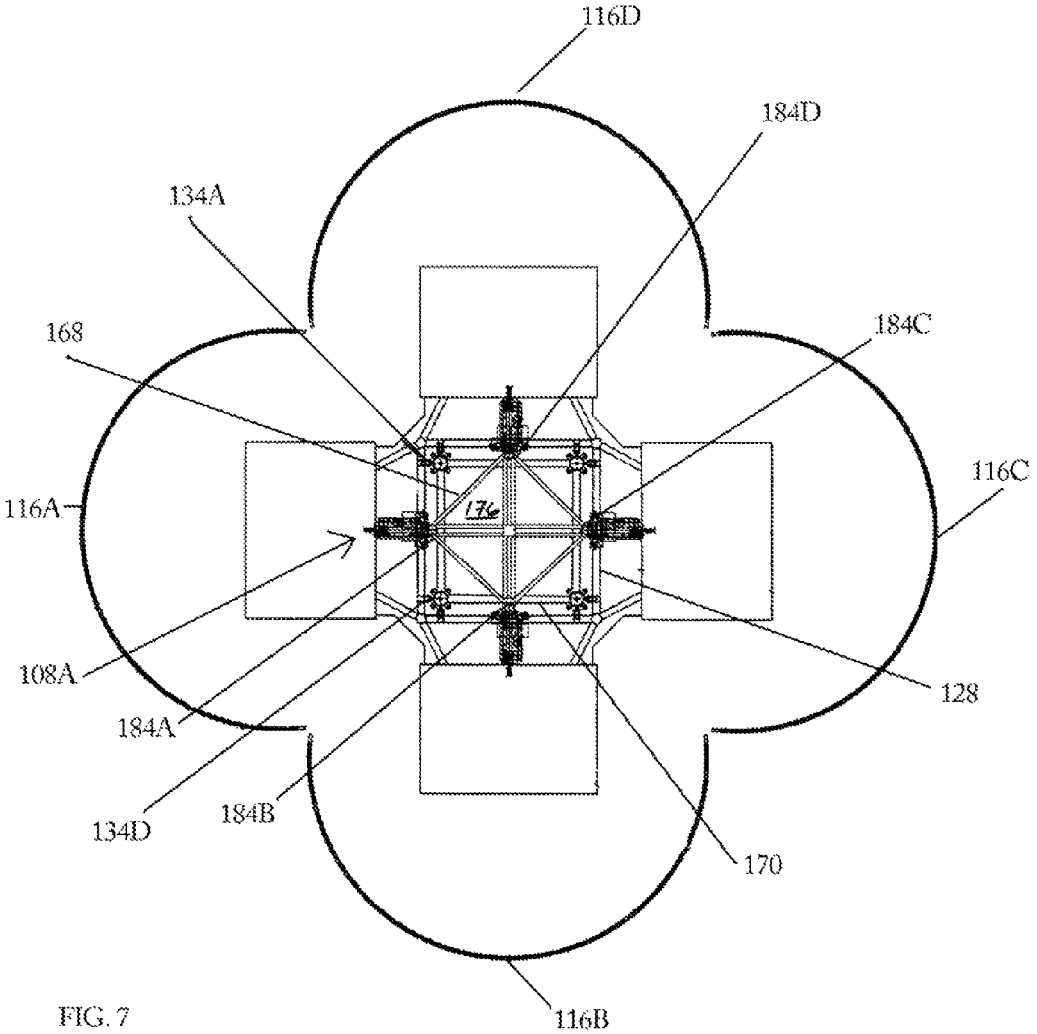
FIG. 7 is a plan view of the rider trolley truss, rider tower truss, and projector tower of the embodiment of the tower ride shown in FIG. 6.
Figure 8:
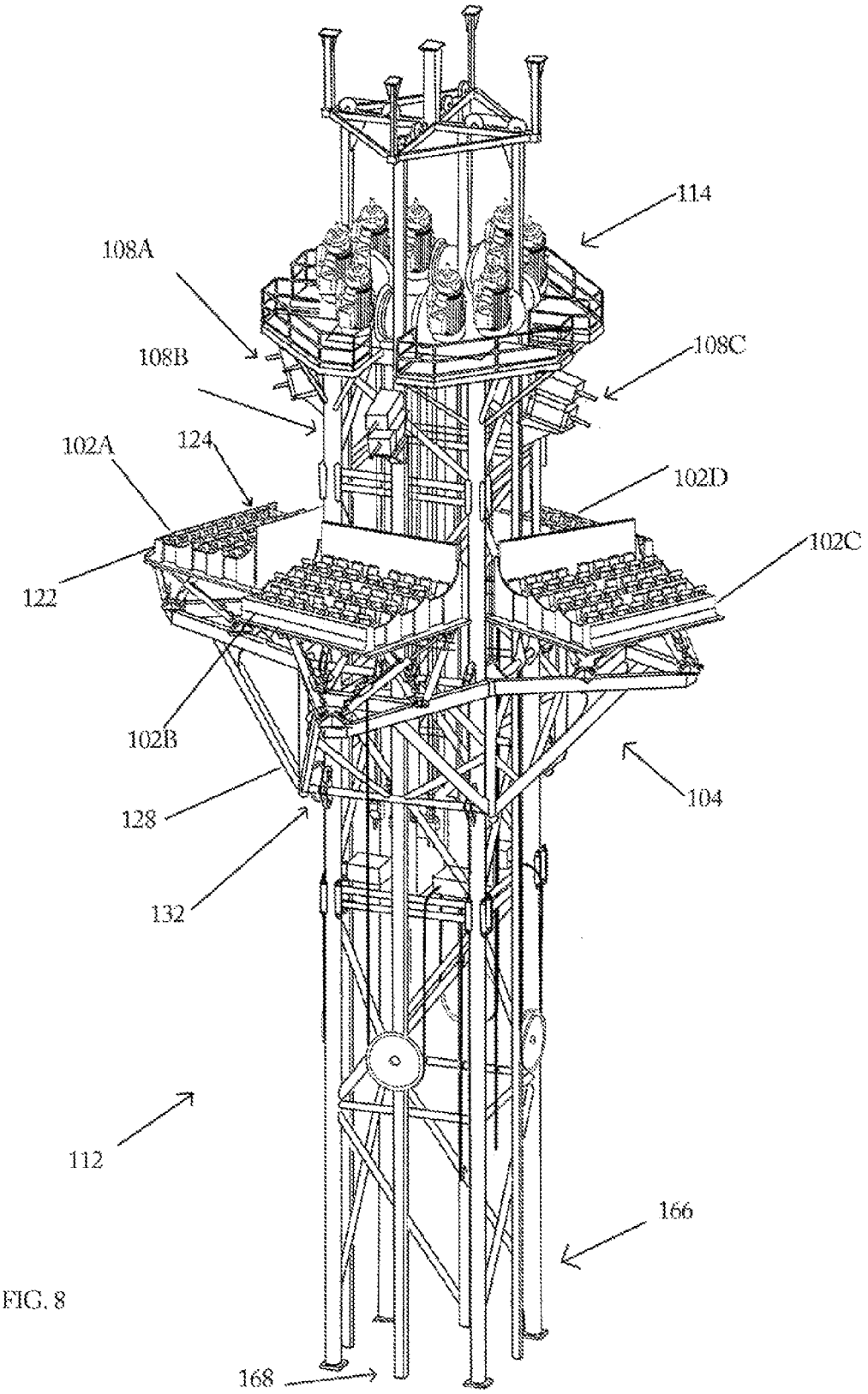
FIG. 8 illustrates the tower structure and elements supported by or associated with the tower structure of the embodiment of the tower ride shown in FIG. 6.
Figure 10:
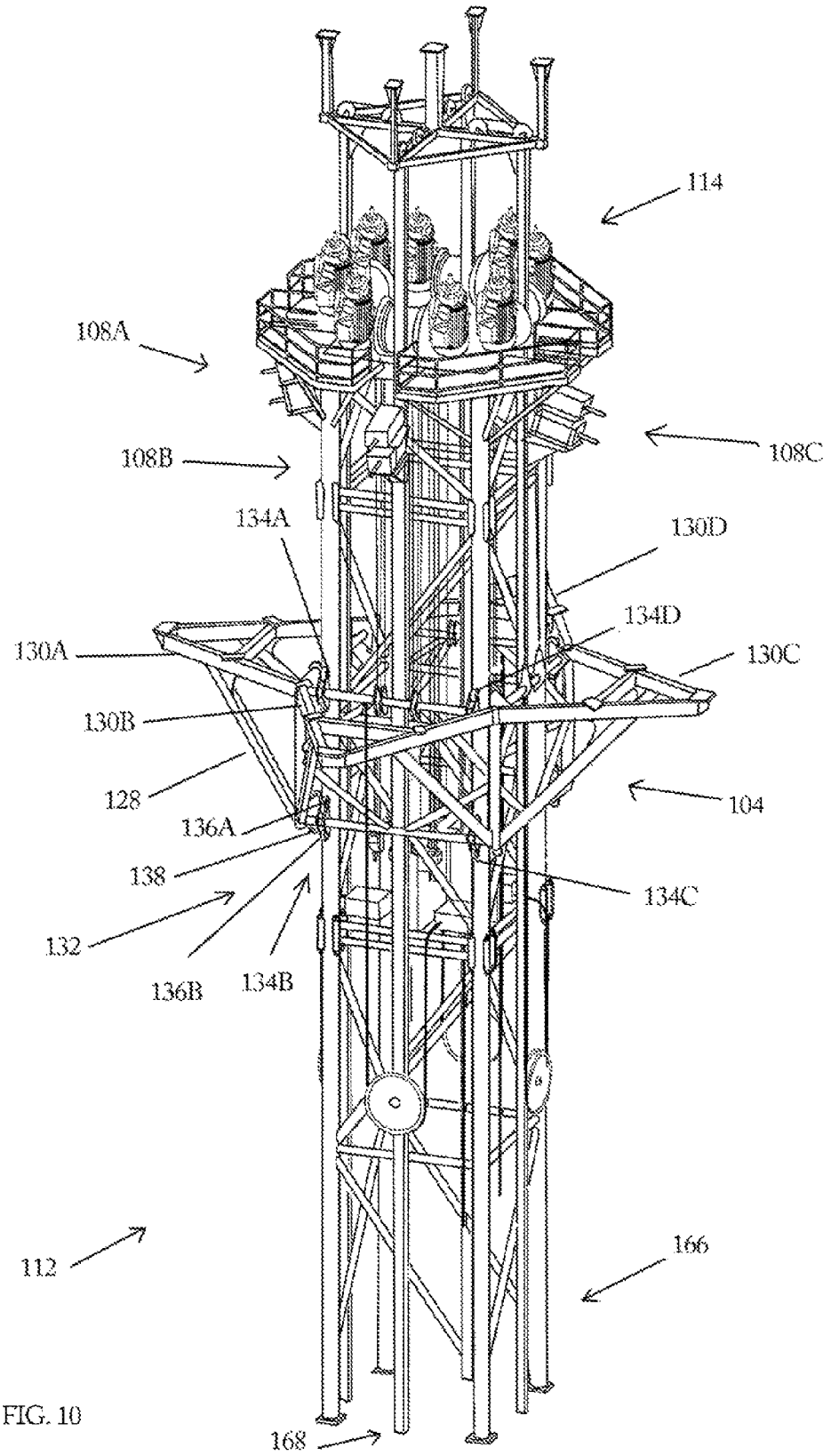
FIG. 10 illustrates the tower structure and elements supported by or associated with the tower structure other than the rider station and actuator system of the embodiment of the tower ride tower ride shown in FIG. 6.

The rider trolley 104 includes a truss structure 128, four platforms 130A-130D that each support one of the rider stations 102A-102D, and tower engagement wheels 132 that engage the tower structure 112 such that the rider trolley 104 is constrained to moving vertically up and down a portion of the tower structure 112. In the illustrated embodiment, the engagement wheels 132 include four sets of wheels associated with each of the rider stations 102A-102D. With reference to FIG. 10, the four sets of wheels associated with the rider station 102B are described with the understanding that the description is also applicable to the four sets of wheels associated with each of the other rider stations 102B-102D. Associated with rider station 102A are four sets of wheels 134A-134D. Each of the four sets of wheels 134A-134D is comprised of a pair of wheels 136A, 136B and a frame 138 that supports the wheels and engages the truss structure 128. With reference to FIG. 7, the rider trolley 104 generally forms a closed-loop structure that surrounds the portion of the tower structure 112 that is contacted by the engagement wheels 132.

Figure 9:
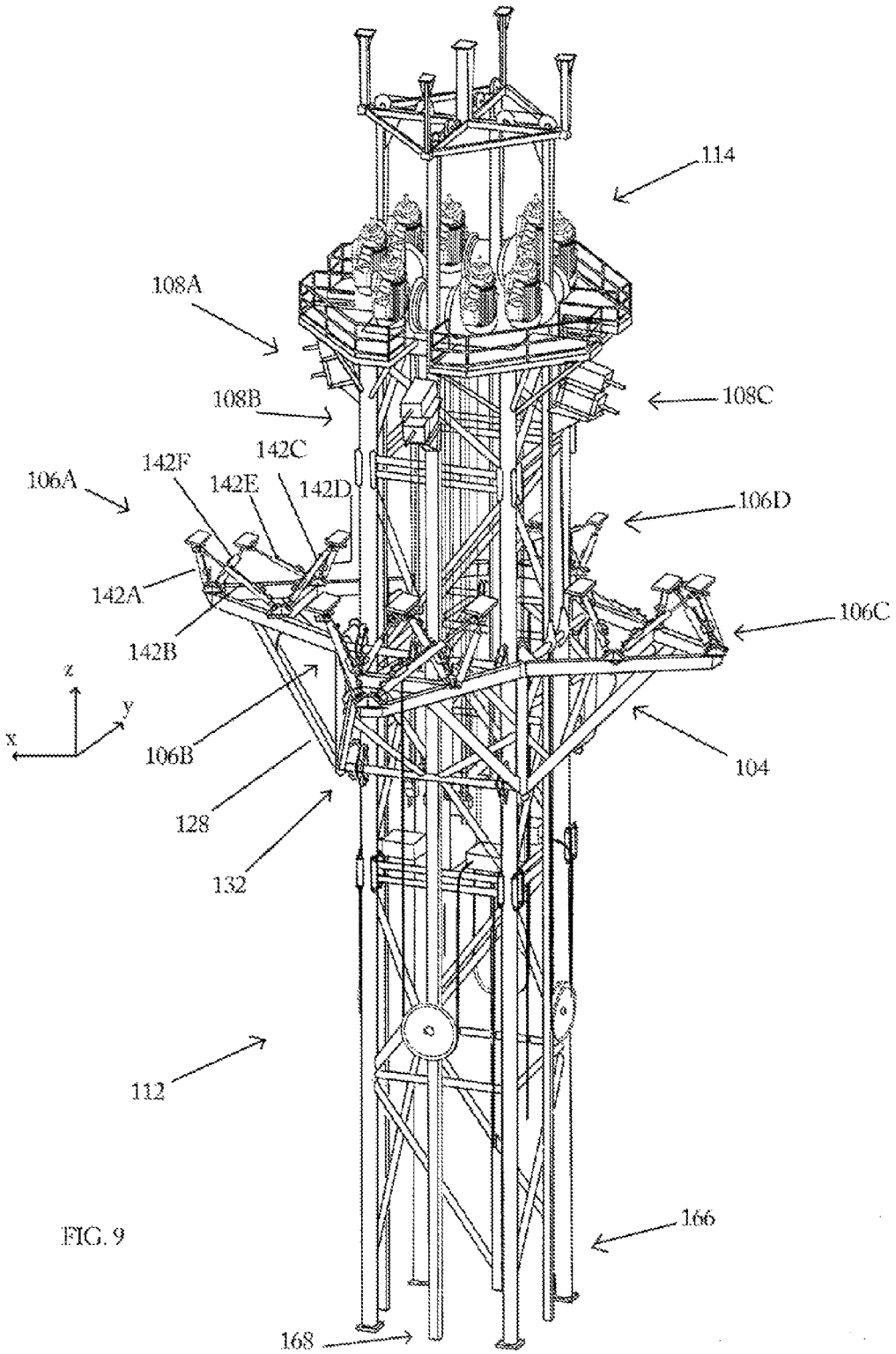
FIG. 9 illustrates the tower structure and elements supported by or associated with the tower structure other than the rider stations of the embodiment of the tower ride shown in FIG. 6.

The actuator systems 106A-106D are substantially identical to one another. Consequently, actuator system 106A is described with the understanding that the description is also applicable to actuator systems 106B-106D. With reference to FIG. 9, the actuator system 106A is comprised of six prismatic actuators 142A-142F that are used to implement what is commonly referred to as a Stewart motion platform in which the length of each of the actuators 142A-142F can be controlled to move the car 122 in any combination of six degrees of freedom. As such, the actuators l42A-142F can be used to: (a) selectively impart linear motion to the car 122 along x, y, and z axes and (b) selectively impart rotational motion to the car 122 about the x, y, and z axes. Each of the actuators 142A-142F includes a first end that is operatively connected to the platform 130A with a U-joint and a second end that is attached to the car 122 associated with the rider station 102A with a U-joint. The actuators 142A-142F are oriented relative to one another so as to implement a Stewart motion platform. The actuator system 106A further includes a valve manifold 144 with an input side connected to hydraulic fluid line 145A, six valves that correspond to the six prismatic actuators 142A-142F, and output side connected to six hydraulic fluid lines 145B (shown collectively as a single line), one for each of the prismatic actuators. The controller 118 is adapted to control each of the six valves and thereby regulate the hydraulic fluid provided to each of the prismatic actuators 142A-142F, which determines the length of each of the prismatic actuators. A linear encoder associated with each of the prismatic actuators 142A-142F provides feedback information to the controller concerning the operation of the actuator (e.g., length and speed at which length is increasing or decreasing).

Figure 13A:
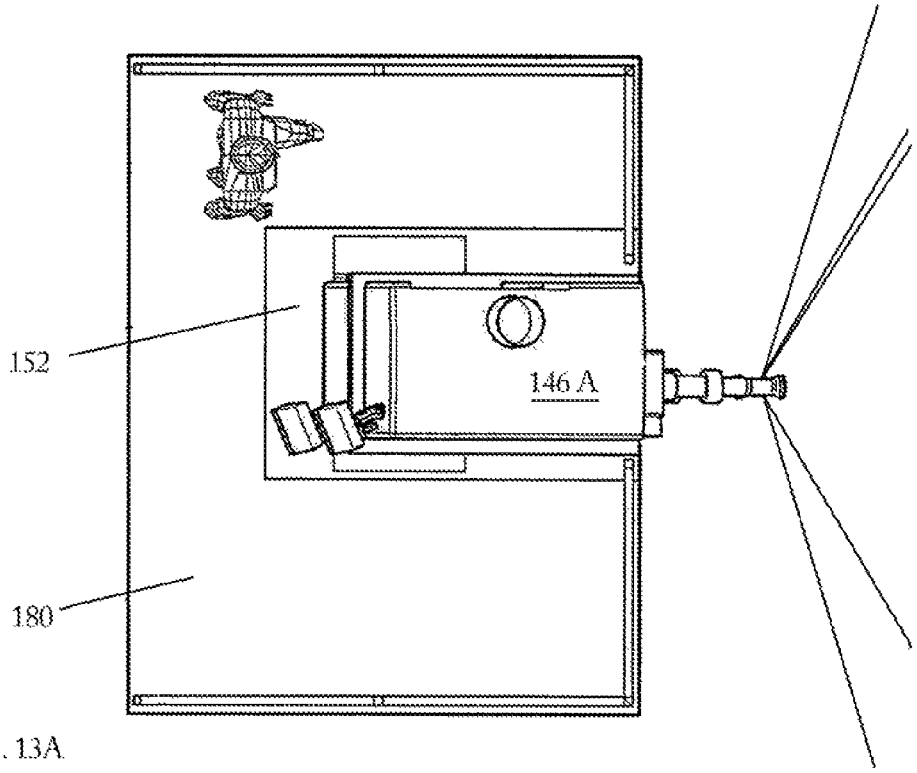
FIGS. 13A and 13B respectively are plan and side views of a portion of a projector trolley, a projector system, and a mount for connecting the projector system to the projector trolley.
Figure 13B:
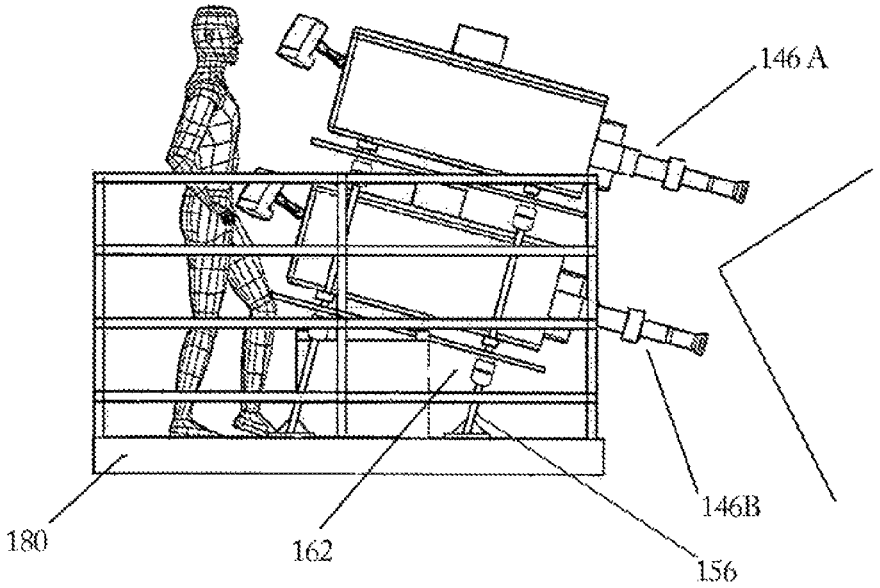
Figure 14:
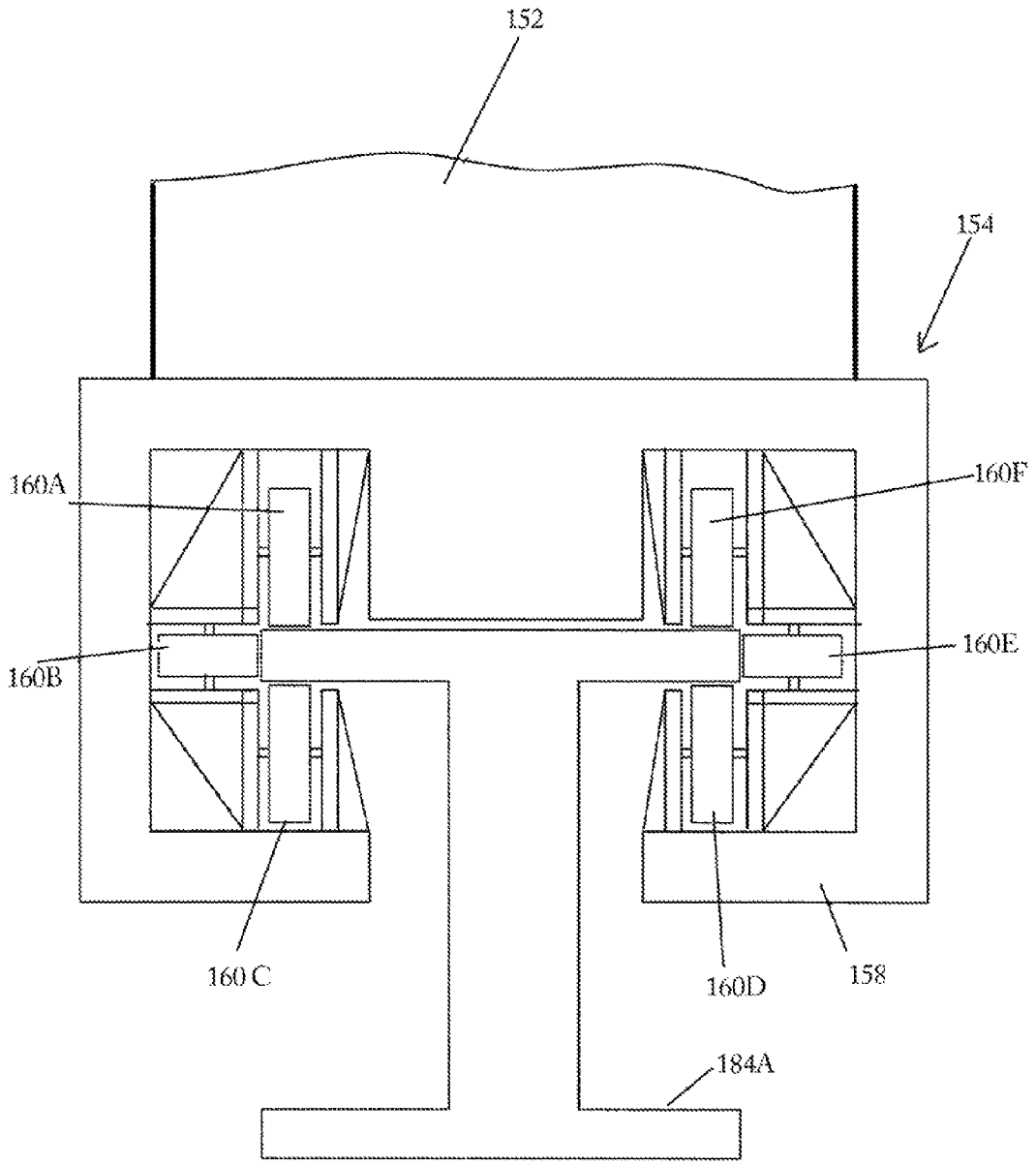
FIG. 14 is a plan view of the wheeled engagement structure for connecting a projector trolley to an I-beam associated with the projector tower.
Figure 15:
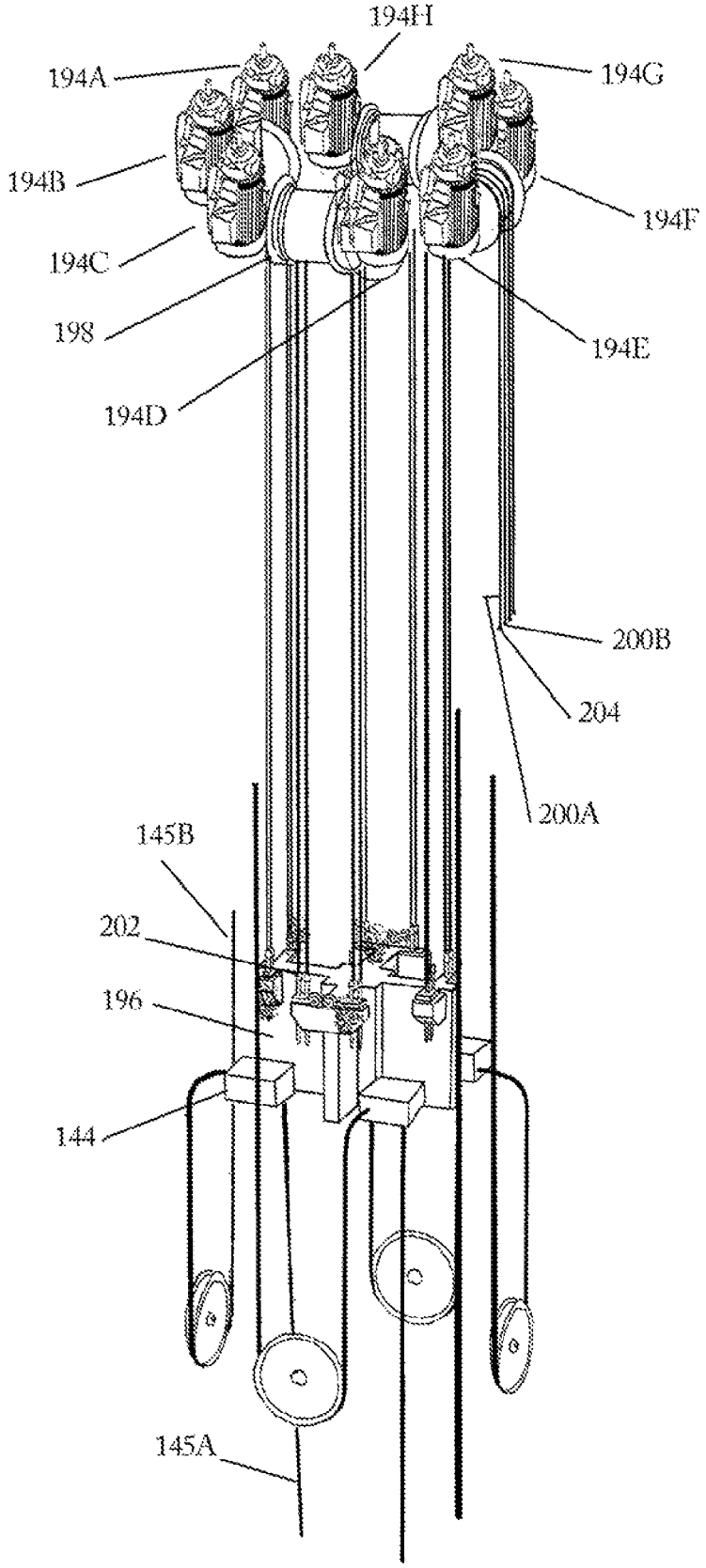
FIG. 15 is a free body diagram of the motor system supported by the rider station tower shown in FIG. 11 and used to vertically move the rider trolley along the tower.
Figure 16:
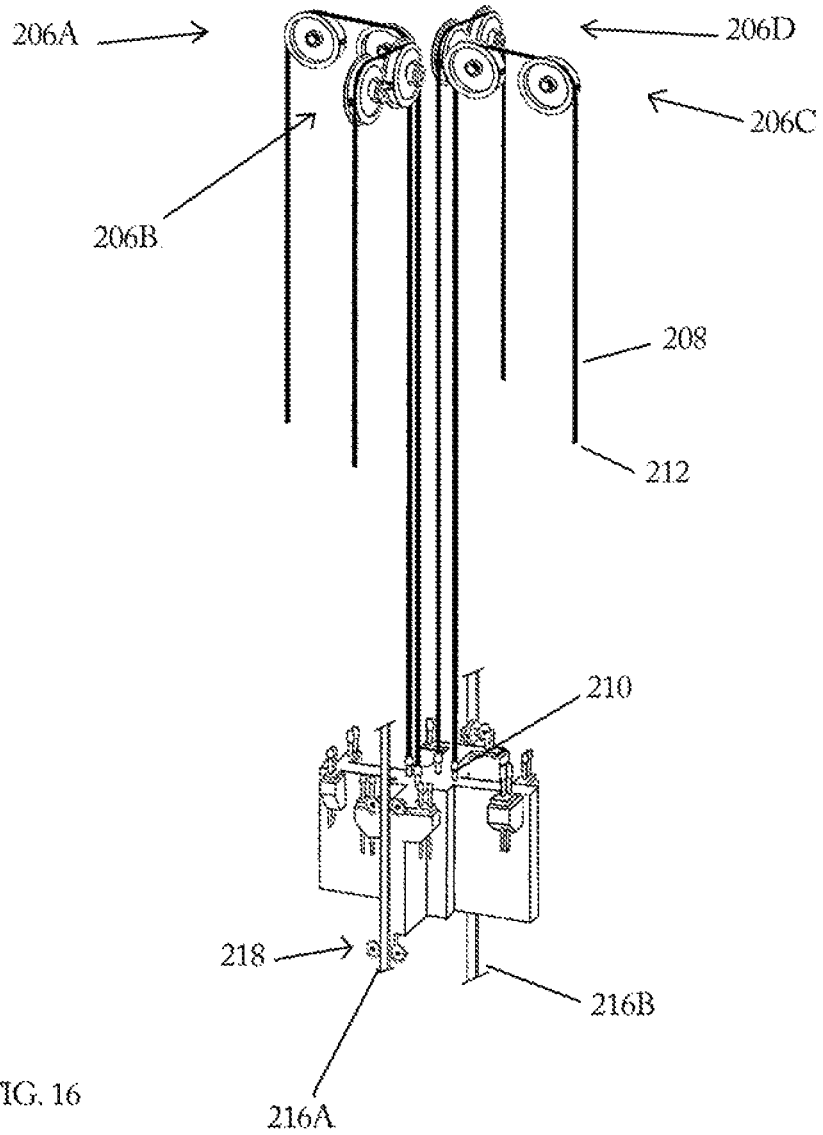
FIG. 16 is a free body diagram to an embodiment of a cable system used to couple the projector trolleys to the counterweight associated with the motor system illustrated in FIG. 15.

The projector systems 108A-108D are substantially identical to one another. Consequently, projector system 108A is described with the understanding that the description is also applicable to projector systems 108B-108D. With reference to FIGS. 13A and 13B, the projector system 108A includes first and second projectors 146A, 146B that are vertically oriented and used to project stereoscopic imagery onto the screen 116A that will appear to be three-dimensional to riders utilizing appropriate eyewear for facilitating such images. Each of the projectors 146A, 146B can, if needed, incorporate a motion stabilization system to attenuate vibrations that may adversely affect the quality of the image being projected by the projector onto the screen. A projector system that produces 2D images is also feasible.

The projector trolleys 110A-110D are substantially identical to one another. Consequently, projector trolley 110A is described with the understanding that the description is also applicable to projector trolleys 110B-110D. With reference to FIGS. 12, 13A, 13B, and 14, the projector trolley 110A includes a truss 150, a platform 152 to which the first and second projectors 146A, 146B are mounted, and a wheeled engagement structure 154 that engages a portion of the tower structure 112 such that the projector trolley 110A is constrained to moving vertically up and down a portion of the tower structure 112, and a mount 156 for attaching the first and second projectors 146A, 146B to the platform 152. The wheeled engagement structure 154 includes a frame 158 that engages the truss 150 and supports wheels 160A-160F that engage a portion of the tower structure 112 in manner that constrains the projector trolley 110A to moving vertically up and down the tower structure. In the illustrated embodiment, the mount 156 includes a damper mechanism 162 that attenuates the transmission of vibrations from the projector trolley 110A to the projectors 146A, 146B. A single projector trolley that supports all four projector systems 146A-146B is feasible.

Figure 11:
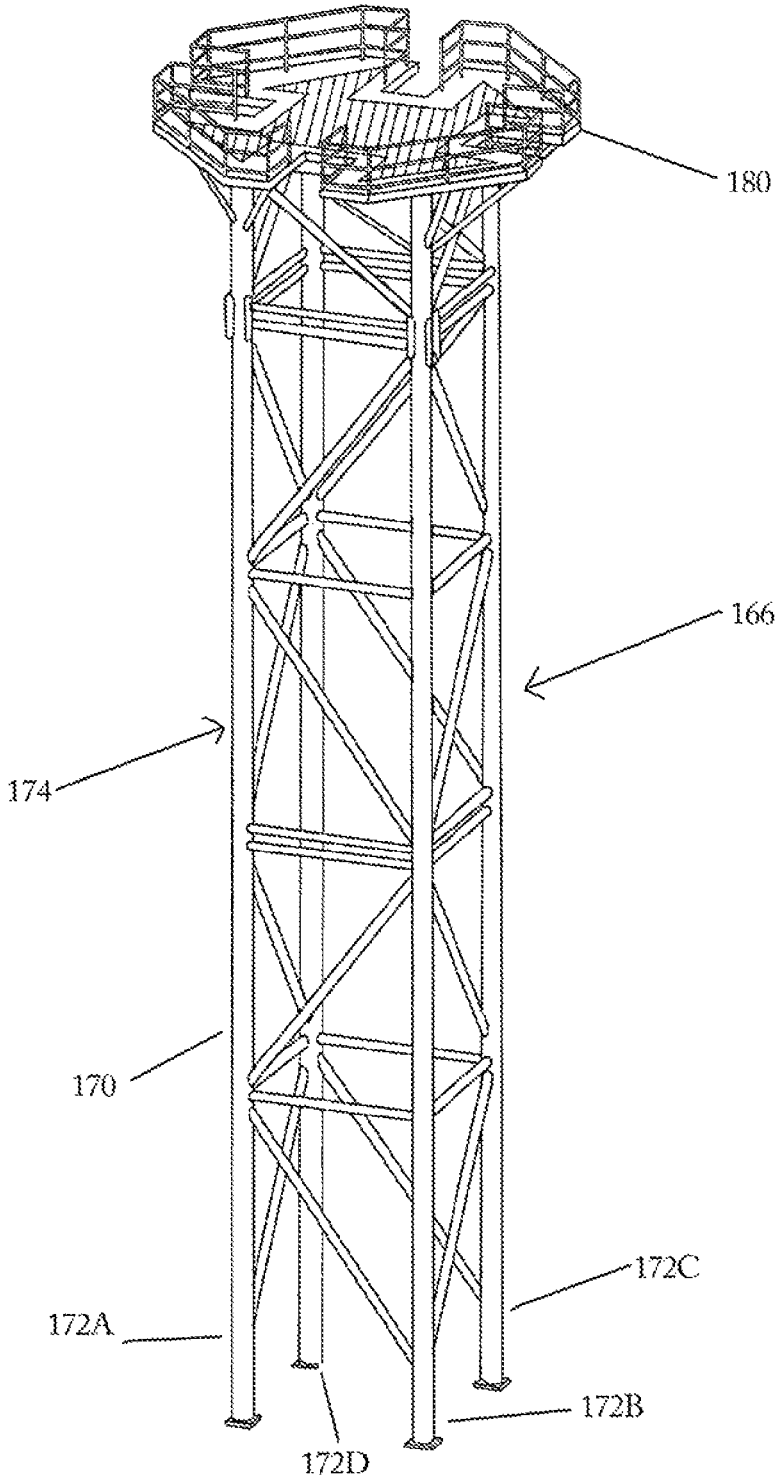
FIG. 11 illustrates the rider station tower that supports, among other elements, the rider trolley and the motor system that is used to vertically move the rider trolley along the tower in the embodiment of the tower ride shown in FIG. 6.
Figure 12:
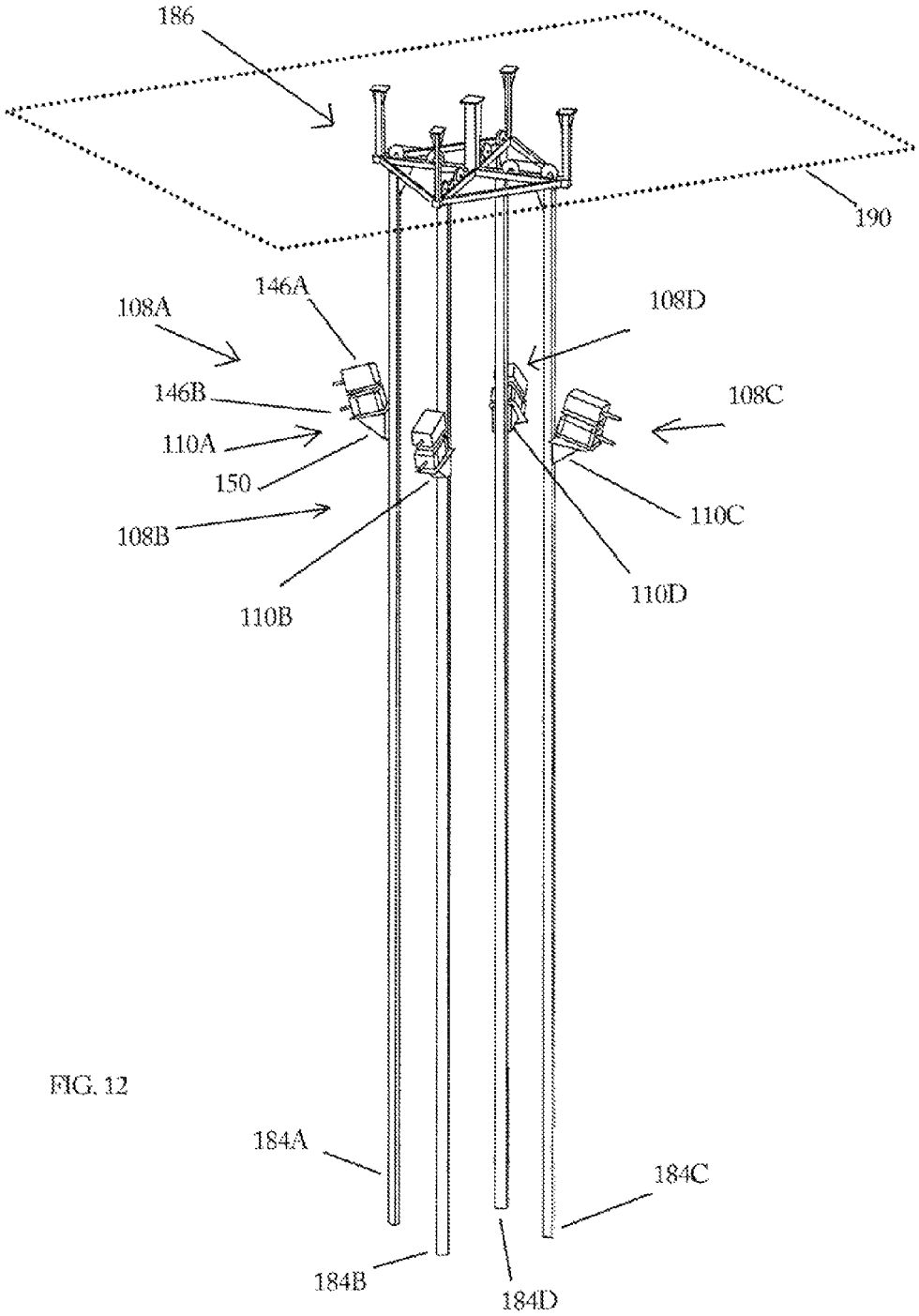
FIG. 12 illustrate the projector tower that supports the projector trolley of the embodiment of the tower ride shown in FIG. 6.

With reference to FIGS. 11 and 12, the tower structure 112 is comprised of a rider station tower 166 and a projector tower 168. Generally, the rider station tower 166 serves to vertically guide the displacement of the rider trolley 104 by the motor system 114 and support other elements of the tower ride 100. Generally, the projector tower 168 serves to vertically guide the displacement of each of the projector trolleys 110A-110D. In the illustrated embodiment, the tower structure 112 extends approximately 34 m above a foundation surface. In normal operation, the rider trolley 104 is capable of being moved over approximately 14 m of the 34 m extent of the tower structure 112.

The rider station tower 166 in the illustrated embodiment includes a box truss 170 having four vertically extending, parallel posts 172A-172D that are connected to one another by cross bracing 174. With reference to FIG. 7, each of the posts 172A-172D is adapted to capture engagement wheels associated with two of the rider stations 102A-102D. In one embodiment, each of the posts employs two longitudinally extending grooves to capture the wheels associated with two of the rider stations, one groove to capture the wheels associated with one of the rider stations and the other groove to capture the wheels associated with the other rider station. The box truss 170 defines an interior space 176 that accommodates other elements of the tower ride 100 and has a substantially square lateral cross-section. The lower ends of the posts 172A-172D are embedded in a foundation 178. The upper ends of the posts 172A-172D operatively engage a motor platform 180 that supports the motors used to drive the rider trolley 104 vertically up and down the rider station tower 166.

The projector tower 168 in the illustrated embodiment includes four vertically extending, parallel I-beams 184A-184D and a crown structure 186. Each of the four I-beams 184A-184D is adapted to cooperate with the engagement structure 154 of a corresponding one of the projector trolleys 110A-110D to vertically guide the trolley up and down the post. The lower ends of the posts 184A-184D are embedded in the foundation 178. The upper ends of the posts 184A-184D are operatively engaged to the crown structure 186. The crown structure 186 serves to connect the posts 184A-184D to one another, support portions of the motor system 114 that are used in moving the projector trolleys 110A-110D and the related projector systems 108A-108D, and provide an interface 188 for connecting the crown structure 186 and posts 184A-184D to a ceiling 190 of a building that encloses the tower structure 112 and the screens 116A-116D to provide an adequately dark environment for riders to enjoy the images produced on the screens 116A-116D by the projector systems 108A-108D. Connecting the projector tower to the ceiling of the building provides additional support to the projector tower 168 and potentially dampens vibrations that may be imparted to the projector tower 168 and the projector systems 108A-108D during operation of the ride 100.

The rider station tower 166 and the projector tower 168 are separated from one another over the entire extent of each of the towers above the foundation 178 that supports the towers. This separation is believed to attenuate certain vibrations caused by the vertical displacement of the rider trolley 104 along the rider station tower 158 that could cause the projector systems 108A-108D and the images produced by the projector systems 108A-108D to vibrate to an extent that significantly diminishes the experience of a rider. In the illustrated embodiment, the foundation 178 supports both the rider station tower 158 and the projector tower 160. However, if there is likely to be undesirable vibrational coupling between the towers with a common foundation and the geology of the land on which the rider tower 100 is located is appropriate, separate foundations for the rider tower station 158 and the projector tower 160 may provide additional isolation or attention of vibrations produced during by the vertical displacement of the rider trolley 104.

With reference to FIG. 7, the I-beams 184A-184D of the projector tower 168 that engage the projector trolleys 110A-111D are located between the truss structure 128 of the rider trolley 104 and the box truss 170 of the rider station tower 166. Stated differently, the footprint of the projector tower 168 and, more specifically, the footprint of the I-beams 184A-184D is located between the footprint of the truss structure 128 of the rider trolley 104 and the footprint of the box truss 170 of the rider station tower 166. As such, no portion of the rider station tower 158 is disposed in the projection cones of the projector systems 108A-108D over the extent that the projector systems 108A-108D can be moved along the projector tower 160. Further, during operation of the tower ride 100, the projector trolleys 110A-110D and the rider trolley 104 are separated by a distance that substantially maintained over the entire vertical extent that the rider trolley can be moved. Further, this separation is sufficient to render it unlikely that a typical rider could interpose themselves in the projection cone of the relevant projector system and thereby diminish the imagery being projected on the relevant screen by the projector system.

Figure 17:
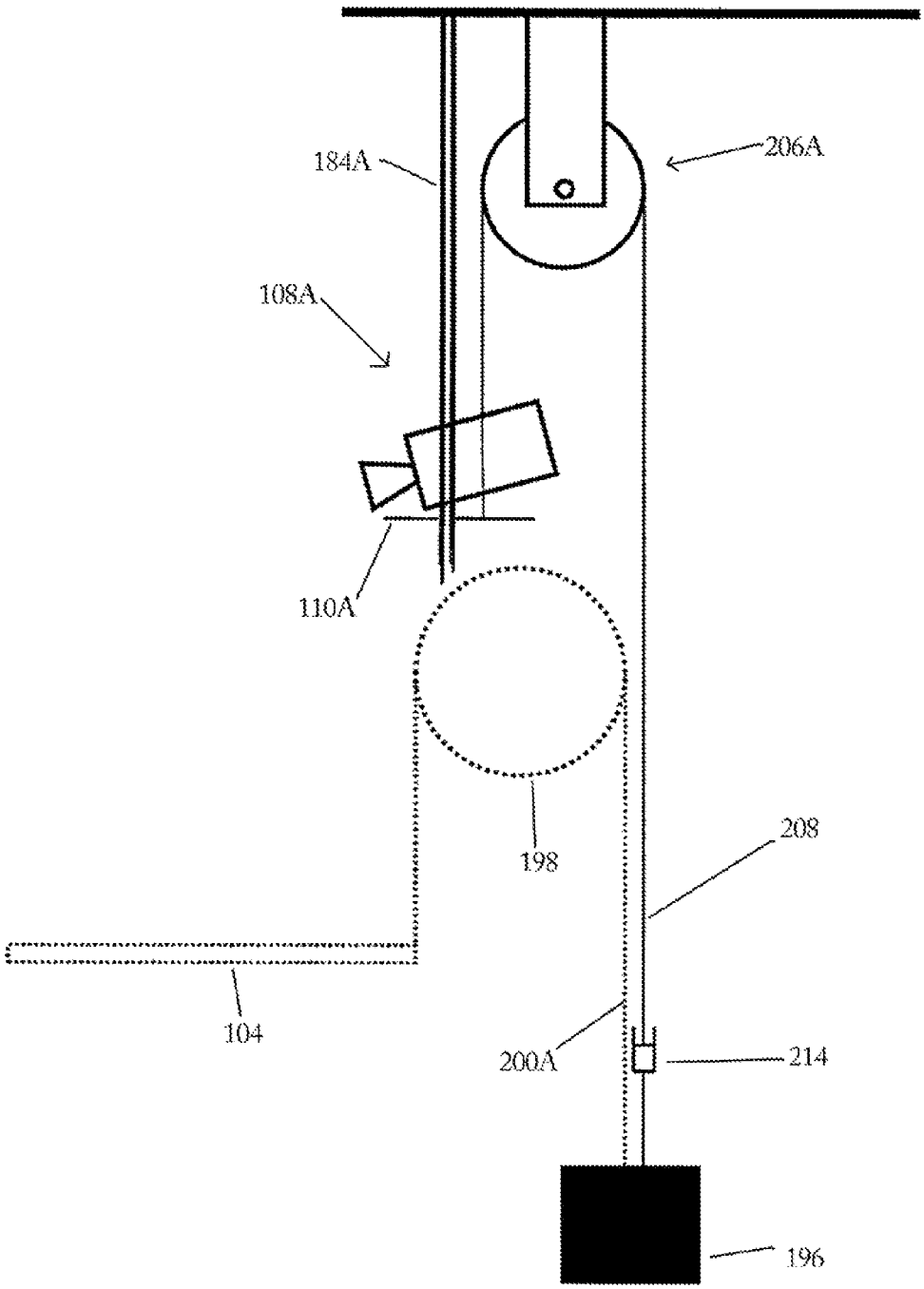
FIG. 17 is a schematic diagram of the coupling between the projector trolley and the rider trolley that is used to maintain a substantially constant spacing between the projector supported by the projector trolley and the rider trolley during vertical displacement of the trolleys.

The motor system 114 is comprised of motors 194A-194H and a counterweight 196 that provide the force for: (a) vertically moving the rider trolley 104, the structures supported by the trolley, and riders along the rider station tower 166 and (b) vertically moving the projector trolleys 110A-110D and projector systems 108A-108D along the projector tower 168. Each of the motors 194A-194H includes a rotor that drives a sheave 198. Each sheave 198 operatively engages two cables 200A, 200B. Each of the cables 200A, 200B extends from a first end 202 that operatively engages the counterweight 196 to a second end 204 that operatively engages the rider trolley 104. The motor system 114 also includes four pairs of pulleys 206A-206D that are supported by the crown 186 of the projector tower 168. Each of the pairs of pulleys 206A-206D supports a cable 208. Each cable 208 includes a first end 210 that operatively engages the counterweight 196 and a second end 212 that operatively engages one of the projector trolleys 110A-110D. Due to this connection of the projector trolleys 110A-110D to the counterweight 196, each of the projector trolleys 110A-110D is maintained at a substantially constant distance from rider trolley 104. In the illustrated embodiment, each cable 208 includes a damper 214 for attenuating vibrations that may adversely affect the video image being projected by the relevant one of the projector systems 108A-108D onto the relevant one of the screens 116A-116D. FIG. 17 schematically illustrates the manner in which cable 202A (extending between the truss structure 128 of the rider trolley 104 and the counterweight 196, cable 208 (extending between the projector trolley 110A and the counterweight 196), pulleys 206A (shown as a single pulley), and sheave 198 associated with motor 194A are configured so as to maintain a substantially constant distance between the projector trolley 110A and the rider trolley 104. Also shown in FIG. 17 is the damper 214 that is part of cable 208. A pair of guide rails 216A, 216B that extend between the foundation 178 and the motor platform 180 cooperate with a plurality of pairs of guide wheels 218 attached to the counterweight 196 to vertically guide the counterweight 196 during operation.

In the illustrated embodiment, each of the motors 194A-194H is a helical gear motor with a power of approximately 200 kW. Further, the motors 194A-194H are capable of imparting a maximum acceleration/deceleration to the rider trolley 104 (and supported elements and riders) and to the projector trolleys 110A-110D (and supported elements) of 2.5 $m/s^2$. Further, the motors 194A-194H are capable of imparting a maximum speed to the rider trolley 104 (and supported elements and riders) and to the projector trolleys 110A-110D (and supported elements) of 5 m/s.

Each of the screens 116A-116D is comprised of a perforated aluminum panel 222 that is powder coated on the side of the panel facing the relevant one of the rider stations 102A-102D. The perforations in the panel facilitate the projection of sound into the enclosed area defined by the screens 116A-116D that is produced by speakers located opposite side of the panels. Associated with the screens 116A-116D is a support structure 224 that supports each of the screens.

Generally, the controller 118 is a computer device that controls the operation of the projectors systems 108A-108D, the motor system 114, and the actuator systems 106A-106D. More specifically, the controller 118 issues control signals that cause: (a) the projector systems 108A-108D to project video imagery on the screens 116A-116D, (b) the motor system 114 to move the rider trolley 104 and the rider stations 102A-102D in a manner that is coordinated with or synchronized to the movement of some object in the projected imagery, and (c) the actuator systems 106A-106D to move each car 122 in a manner that is coordinated with or synchronized to the movement of some object in the projected imagery.

With respect to the projector systems 108A-108D, the controller 118 issues commands that commence the playback of a video recording that is projected by each of the projector systems 108A-108D onto the related screen 116A-116D and the termination of the playback. Further, if several video recording are available for playback, the controller 118 can issue commands that commence the playback of a particular video recording from the selection of video recordings, a sequence in which the video recordings are to be played, or generate random playback sequences. The controller 118 issues the command to commence playback of a video recording to one or more servers that are storing the video recording(s). The video signal is then provided by the one or more servers to each of the projector systems 108A-108D via a digital video signal cable.

With respect to the motor system 114, the controller 118 provides control signals to the motors 194A-194H that cause the rotors to: (a) not rotate and maintain whatever positions the rider trolley 104 and the projector trolleys 110A-110D respectively have to the rider station tower 166 and the projector tower 168; (b) rotate in a direction that causes the rider trolley 104 and the projector trolleys 110A-110D respectively to be vertically displaced upward along the rider station tower 166 and the projector tower 168; (c) rotate in a direction that cause the rider trolley 104 and the projector trolleys 110A-110D respectively to be vertically displaced downward along the rider station tower 166 and the projector tower 168; (d) rotate at an angular speed that is substantially constant, thereby causing the rider trolley 104 and the projector trolleys 110A-110D respectively to move at a substantially constant rate of speed along the rider station tower 166 and the projector tower 168; or (e) rotate at an angular speed that changes over time, thereby causing the rider trolley 104 and the projector trolleys 110A-110D respectively to accelerate/decelerate along the rider station tower 166 and the projector tower 168. Regardless of the type of control signal that is issued to the motors 194A-194H by the controller 118, the control signal results in each car 122 being positioned or moved in by the motors 194A-194H in a manner that is coordinated with or synchronized to the movement of some object in the projected imagery. A linear encoder system that includes a code band mounted on one of the legs of the posts 172A-172D of the rider station tower and a code band reader head mounted on the rider trolley 104 provide the controller 118 with data that can be used to determine the position, speed, and acceleration/deceleration of the rider trolley 104.

With respect to the actuator systems 106A-106D, the controller 118 issues control signals to each of the actuator systems 106A-106D. With respect to each of the actuator system 106A-106D, control signals are conveyed over a communication path to the valve manifold 144, which in turn adjusts the lengths of each of the prismatic actuators 142A-142F, if needed and as needed. The control signal(s) provided to each of the actuator systems 106A-106D can cause the actuator system to: (a) maintain the existing position of the car or (b) move the attached car 122 in some combination of the six degrees of freedom provided by the actuator system, i.e., move the car in one or more of the roll, pitch, yaw, surge, heave, and sway directions. Further, with respect to the roll, pitch, and yaw movement, the controller 118 also indicates the direction of rotation about the relevant axis. Similarly, with respect to surge, heave, and sway, the controller 118 specifies the direction of translation along the relevant axis (i.e., whether the translation is in a positive or negative direction along the relevant axis).

It should be appreciated that controller 118 is capable of causing movement of each car by use of the motor system 114 and cause simultaneous movement to be imparted to each car by use of the actuator systems 106A-106D. Consequently, relatively complex movements can be imparted to each car. For instance, the motor system 114 can be used to impart a high-amplitude and low-frequency movements to each car while the actuator systems 106A-106D simultaneously impart low-amplitude and high-frequency movements to each car. The controller 118 can also cause all of the cars to move by use of the motor system 114 alone, i.e., without using the actuator systems 106A-106D to move the cars relative to the rider trolley 104. Conversely, the controller 118 is also adapted to cause all of the cars to move by use of the actuator systems 106A-106D alone, i.e., with using the motor system 114 to move the cars.

In the case of simultaneous movement of the cars by both the motor system 114 and the actuator systems 106A-106D, it should be additionally appreciated that the controller 118 is capable of causing the actuator system 106A-106D to impart movement to the cars over substantially the entire range of positions that the motor system 114 can establish for the rider trolley 104.

The foregoing description of the invention is intended to explain the best mode known of practicing the invention and to enable others skilled in the art to utilize the invention in various embodiments and with the various modifications required by their particular applications or uses of the invention.

What is claimed is:

1. An amusement ride apparatus comprising:

a rider station for supporting a rider in a predetermined position;

a rider station trolley for supporting the rider station;

a rider station tower operatively engaged with the rider station trolley such that the rider station trolley can move vertically along the rider station tower;

a motor system operatively engaged with the rider station trolley for vertically moving the rider station trolley and the rider station along the rider station tower;

an actuator system for moving the rider station relative to the rider station trolley;

a screen located for viewing by a rider supported in the predetermined position in the rider station;

a projector for projecting imagery on the screen; and a controller operatively engaged with the projector, the motor system, and the actuator system and adapted to cause: (a) the motor system to vertically position the rider station along the rider station tower so as to coordinate the vertical position of the rider station with imagery produced by the projector and displayed on the screen and (b) the actuator system to position the rider station relative to the rider station trolley so as to coordinate the position of the rider station relative to the rider station trolley with imagery produced by the projector and displayed on the screen;

wherein, in coordinating the position of the rider station relative to the rider station tower and the rider station trolley with imagery being displayed on the screen, the controller is capable of causing:

(a) the motor system to vertically move the rider station trolley and rider station along the rider station tower and the actuator system to simultaneously maintain a position of the rider station relative to the rider station trolley, (b) the motor system to maintain the position of the rider station trolley and rider station along the rider station tower and the actuator system to simultaneously move the rider station relative to the rider station trolley, and (c) the motor system to vertically move the rider station trolley and rider station along the rider station tower and the actuator system to simultaneously move the rider station relative to the rider station trolley.

2. An amusement ride apparatus, as claimed in claim 1, wherein:

the actuator system is capable of providing a combination of: surge, sway, heave, roll, pitch, and yaw movement of the rider station relative to the rider station trolley.

3. An amusement ride apparatus, as claimed in claim 1, further comprising:

a projector trolley for supporting the projector and moving the projector substantially synchronously with the rider station trolley.

4. An amusement ride apparatus, as claimed in claim 3, further comprising:

a projector tower, separate from the rider station tower, operatively engaged with the projector trolley such that the projector trolley can move vertically along the projector tower.

5. An amusement ride apparatus, as claimed in claim 3, wherein:

the projector trolley is operatively engaged with the rider station tower such that the projector trolley can move vertically along the rider station tower.

6. An amusement ride apparatus, as claimed in claim 1, further comprising:

a projector mount for supporting the projector, the projector mount extending between the rider station trolley and the projector.

7. An amusement ride apparatus, as claimed in claim 4, wherein:

the rider station and the rider station trolley collectively have a rider station footprint;

the rider station tower has a rider station tower footprint;

the projector tower has a projector tower footprint;

wherein the projector tower footprint is located between the rider station footprint and the rider station tower footprint.

8. An amusement ride apparatus comprising:

a rider station for supporting a rider in a predetermined position;

a rider station trolley for supporting the rider station;

a rider station tower operatively engaged with the rider station trolley such that the rider station trolley can vertically move along the tower;

a motor system operatively engaged with the rider station trolley for vertically moving the rider station trolley and the rider station along the tower;

a screen located for viewing by a rider supported in the predetermined position in the rider station and stationary relative to the rider station trolley;

a projector for projecting imagery on the screen;

a projector mount for supporting the projector and adapted to move substantially synchronously with the rider station trolley; and a controller operatively engaged with the projector and the motor system and adapted to cause the motor system to vertically position the rider station along the rider station tower so as to coordinate the vertical position of the rider station with imagery produced by the projector and displayed on the screen.

9. An amusement ride apparatus, as claimed in claim 8, further comprising:

a projector trolley for supporting the projector mount and moving the projector substantially synchronously with the rider station trolley.

10. An amusement ride apparatus, as claimed in claim 9, further comprising:

a projector tower, separate from the rider station tower, operatively engaged with the projector trolley such that the projector trolley can move vertically along the projector tower.

11. An amusement ride apparatus, as claimed in claim 10, wherein:

the motor system includes a cable that operatively engages the projector trolley.

12. An amusement ride apparatus, as claimed in claim 11, wherein:

the cable includes a damper.

13. An amusement ride apparatus, as claimed in claim 11, further comprising:

a counter-weight operatively connected to the cable.

14. An amusement ride apparatus, as claimed in claim 13, wherein:

the motor system also includes the counter-weight.

15. An amusement ride apparatus, as claimed in claim 9, wherein:

the projector trolley is operatively engaged with the rider station tower such that the projector trolley can vertically move along the rider station tower.

16. An amusement ride apparatus, as claimed in claim 8, wherein:

the projector mount extends between the rider station trolley and the projector.

17. An amusement ride apparatus, as claimed in claim 8, further comprising:

an actuator system for moving the rider station relative to the rider station trolley;

wherein the actuator system is capable of providing a combination of: surge, sway, heave, roll, pitch, and yaw movement of the rider station relative to the rider station trolley.

18. An amusement ride apparatus, as claimed in claim 17, wherein:

the controller is operatively engaged to the actuator system and adapted to cause the actuator system to position the rider station relative to the rider station trolley so as to coordinate the position of the rider station relative to the rider station trolley with imagery produced by the projector and displayed on the screen;

wherein, in coordinating the position of the rider station relative to the rider station tower and the rider station trolley with imagery being displayed on the screen, the controller is capable of causing:

(a) the motor system to vertically move the rider station trolley and rider station along the rider station tower and the actuator system to simultaneously maintain a position of the rider station relative to the rider station trolley, (b) the motor system to maintain the position of the rider station trolley and rider station along the rider station tower and the actuator system to simultaneously move the rider station relative to the rider station trolley, and (c) the motor system to vertically move the rider station trolley and rider station along the rider station tower and the actuator system to simultaneously move the rider station relative to the rider station trolley.

19. An amusement ride apparatus, as claimed in claim 10, wherein:

the rider station and the rider station trolley collectively have a rider station footprint;

the rider station tower has a rider station tower footprint;

the projector tower has a projector tower footprint;

wherein the projector tower footprint is located between the rider station footprint and the rider station tower footprint.

20. An amusement ride apparatus comprising:

a rider station for supporting a rider in a predetermined position;

a rider station trolley for supporting the rider station;

a rider station tower operatively engaged with the rider station trolley such that the rider station trolley can move vertically along the rider station tower;

a motor system operatively engaged with the rider station trolley for vertically moving the rider station trolley and the rider station along the rider station tower;

a screen located for viewing by a rider supported in the predetermined position in the rider station;

a projector for projecting imagery on the screen;

a projector trolley for supporting the projector;

a projector tower operatively engaged with the projector trolley such that the projector trolley can vertically move along the projector tower; and a controller operatively engaged with the projector and the motor system and adapted to cause the motor system to vertically position the rider station along the rider station tower so as to coordinate the vertical position of the rider station with imagery produced by the projector and displayed on the screen.

21. An amusement ride apparatus, as claimed in claim 20, wherein:

the rider station and the rider station trolley collectively have a rider station footprint;

the rider station tower has a rider station tower footprint;

the projector tower has a projector tower footprint;

wherein the projector tower footprint is located between the rider station footprint and the rider station tower footprint.

22. An amusement ride apparatus, as claimed in claim 20, further comprising:

an actuator system capable of imparting a combination of: surge, sway, heave, roll, pitch, and yaw movement to the rider station relative to the rider station trolley.

23. An amusement ride apparatus, as claimed in claim 22, wherein:

the controller is operatively engaged to the actuator system and adapted to cause the actuator system to position the rider station relative to the rider station trolley so as to coordinate the position of the rider station relative to the rider station trolley with imagery produced by the projector and displayed on the screen;

wherein, in coordinating the position of the rider station relative to the rider station tower and the rider station trolley with imagery being displayed on the screen, the controller is capable of causing:

(a) the motor system to vertically move the rider station trolley and rider station along the rider station tower and the actuator system to simultaneously maintain a position of the rider station relative to the rider station trolley, (b) the motor system to maintain the position of the rider station trolley and rider station along the rider station tower and the actuator system to simultaneously move the rider station relative to the rider station trolley, and (c) the motor system to vertically move the rider station trolley and rider station along the rider station tower and the actuator system to simultaneously move the rider station relative to the rider station trolley.

24. An amusement ride apparatus, as claimed in claim 20, wherein:

the motor system includes a cable that operatively engages the projector trolley.

25. An amusement ride apparatus, as claimed in claim 24, wherein:

the cable includes a damper.

26. An amusement ride apparatus, as claimed in claim 24, further comprising:

a counter-weight operatively connected to the cable.

27. An amusement ride apparatus, as claimed in claim 26, wherein:

the motor system also includes the counter-weight.

* * * * *